US007302211B2

(12) United States Patent
Deguchi et al.

(10) Patent No.: US 7,302,211 B2
(45) Date of Patent: Nov. 27, 2007

(54) CHARGING APPARATUS AND IMAGE FORMING APPARATUS WITH PLATED ELECTRODE

(75) Inventors: Masanobu Deguchi, Kashiba (JP); Kazuhiro Matsuyama, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 87 days.

(21) Appl. No.: 11/226,327

(22) Filed: Sep. 15, 2005

(65) Prior Publication Data

US 2006/0062596 A1 Mar. 23, 2006

(30) Foreign Application Priority Data

Sep. 17, 2004 (JP) ..... P2004-272297
Jan. 20, 2005 (JP) ..... P2005-013151
Apr. 27, 2005 (JP) ..... P2005-129828

(51) Int. Cl.
*G03G 15/02* (2006.01)

(52) U.S. Cl. ..... 399/171; 399/173

(58) Field of Classification Search ..... 399/48, 399/50, 168, 170, 171, 173; 430/902; 250/324, 250/325; 361/225
See application file for complete search history.

(56) References Cited

U.S. PATENT DOCUMENTS 4,920,266 A * 4/1990 Reale ..... 250/324
5,257,073 A * 10/1993 Gross et al. ..... 399/171
5,351,111 A * 9/1994 Takafuji et al. ..... 399/171
5,466,938 A 11/1995 Nakayama et al.
5,666,604 A * 9/1997 Nakagami et al. ..... 399/171
7,035,571 B2 * 4/2006 Yoshiyama ..... 399/171
2005/0047829 A1 3/2005 Nakane et al.

FOREIGN PATENT DOCUMENTS

JP 5-163582 A 6/1993
JP 7-240269 A 9/1995
JP 11-40316 A 2/1999
JP 11-212335 A 8/1999
JP 2001-166569 A 6/2001
JP 2002-132023 A 5/2002
JP 2003-91143 A 3/2003
JP 2004-4334 A 1/2004
JP 2004-198909 A 7/2004
JP 2004-198910 A 7/2004
JP 2005-99670 A 4/2005

* cited by examiner

*Primary Examiner*—Sandra L. Brase
(74) *Attorney, Agent, or Firm*—Nixon & Vanderhye, P.C.

(57) ABSTRACT

A charging apparatus having high durability, with no occurrence of rusts or the like, scarcely impaired for the controllability of the charged potential even when contaminants such as a toner are deposited more or less, capable of stably controlling the charged potential on the photoreceptor in an appropriate range for a long time and being inexpensive as well, is provided. A charging apparatus includes a needle electrode, a holding member, two cleaner members, a support member, a moving member, a shield case, and a grid electrode. In the charging apparatus, a nickel plating layer containing polytetrafluoroethylene particles is formed on the surface of the grid electrode.

15 Claims, 6 Drawing Sheets

CHARGING APPARATUS AND IMAGE FORMING APPARATUS WITH PLATED ELECTRODE

BACKGROUND OF THE INVENTION

1. Field of the Invention

The present invention relates to a charging apparatus and an image forming apparatus.

2. Description of the Related Art

In electrophotographic image forming apparatus such as copying machines, printers and facsimile units, images are formed by using a photoreceptor in which a photosensitive layer containing a photoconductive substance on the surface is formed as an image carrier, and applying charges to the surface of the photoreceptor to uniformly charge the same, forming electrostatic latent images corresponding to image information by various image forming processes, developing the electrostatic latent images by a developer containing a toner supplied from developing means into visible images, transferring the visible images on a recording material such as paper, and heating and pressing them by a fixing roller thereby fixing them on a recording material thereby forming images on a recording paper.

In the image forming apparatus described above, a charging apparatus is used for charging the surface of the photoreceptor. The charging apparatus includes, usually, a charging wire (discharging wire) as an electrode for conducting corona discharge, a grid electrode applied with an appropriate voltage and controlling the amount of charges applied by the charging wire to the surface of the photoreceptor, that is, the charged potential on the surface of the photoreceptor, and a support member for supporting the charging wire and the grid electrode Then, as the grid electrode, a wire grid electrode prepared from stainless steel or tungsten, a porous plate grid electrode in which a plurality of perforations are formed to a metal plate formed of a stainless steel or the like (grid substrate), etc. are used. Upon manufacturing the porous plate grid electrode, etching or other methods can be adopted for aperturing the perforations to the metal plate. The porous plate grid electrode manufactured by etching is referred to as an etching grid.

Among these grid electrodes described above, the wire grid electrode involves a problem to be solved that contaminants such as a toner are tended to be deposited, and the function for controlling the charged potential on the surface of the photoreceptor becomes insufficient by the deposition of the contaminants, making the charged potential not uniform on the surface of the photoreceptor.

On the other hand, since the porous plate grid electrode has a relatively larger area compared with the wire grid electrode, the charged potential on the surface of the photoreceptor can be controlled to a proper range and, in addition, the controllability for the charged potential is less lowered even when the contaminants are deposited more or less. Further, since the porous plate grid electrode is formed of iron series metal materials such as stainless steel as described above, it has high durability, causes no disadvantage such as deformation even after long time use, and the change of the controllability for the charged potential due to deformation or the like is extremely small. Accordingly, it is considered that the porous plate grid electrode can control the charged potential on the surface of the photoreceptor substantially constant for a long time. However, while the iron series metal material such as stainless steel as the material for the porous plate grid electrode usually has high durability, it involves a drawback that it is oxidized easily due to water content under a high humidity circumstance and ozone generated upon corona discharge during charging operation. In the use of the porous plate grid electrode for a long time, use under the high humidity circumstance and contact with ozone are inevitable. Accordingly, in the porous plate grid electrode formed from a metal material such as stainless steel, corrosion such as rust occurs due to the water content in air, ozone, etc. and nitrogen oxides are deposited on the surface thereof to deteriorate the durability. In addition, the controlling performance for the charged potential in the photoreceptor becomes insufficient, and it involves a problem to be solved that the charged potential becomes not uniform on the surface of the photoreceptor and a desired charged potential can not be applied always stably to the surface of the photoreceptor.

In view of the problems described above in the porous pate grid electrode, a corona charging apparatus having a grid electrode formed by successively coating a nickel plating layer and a gold plating layer on the surface of a metal plate formed from a stainless steel (grid substrate) has been proposed (for example, refer to Japanese Unexamined Patent Publication JP-A 11-40316(1999)). In the grid electrode, improvement is indeed recognized to some extent in view of the corrosion resistance but it involves a problem that the gold plating layer mainly attributable to the enhancement of the corrosion resistance is tended to be peeled. While the nickel plating layer is formed between the metal plate and the gold plating layer in order to prevent peeling of the plating layer in JP-A 11-40316, the effect is not yet satisfactory.

Further, a charging apparatus having a grid electrode formed directly with a gold plating layer by an electrolytic plating method using a pulse current not by way of a nickel plating layer on the surface of a metal plate formed from a stainless steel (grid substrate) has been proposed (for example, in Japanese Unexamined Patent Publication JP-A 2001-166569). The charging apparatus is used in an image forming apparatus including an organic photoreceptor to be formed with electrostatic images, a charging apparatus for charging the organic photoreceptor, developing means for developing electrostatic latent images formed on the organic photoreceptor into toner images, a transfer portion of transferring the toner images on a recording material, and fixing means for fixing the toner images on the recording material. In the charging apparatus, since the gold plating layer is less peeled, the corrosion resistance and the controllability for the charged potential on the surface of the photoreceptor are satisfactory in the grid electrode. By the way, it is necessary to form the gold metal layer to a thickness of 0.3 μm or more in order that the grid electrode can provide the preferred characteristics sufficiently. In addition, since the grid electrode is a relatively large member having a substantially the same size as the photoreceptor, the amount of gold to be used is necessarily increased also because of the necessity for increasing the thickness of the plating layer. However, use of gold in such a great amount unnecessarily increases the cost of the charging apparatus and, thus, impairs the general applicability of the image forming apparatus due to the relatively reduced cost, which is one of the advantages of the image forming apparatus. Accordingly, it has been demanded for a charging apparatus not using an expensive material such as gold and excellent in the durability and the controllability for the charged potential on the surface of the photoreceptor.

Further, the charging apparatus comprises an electrode for conducting corona discharge to the photoreceptor, a grid electrode as an electrode which is disposed optionally between the surface of the photoreceptor and the electrode for controlling amount of charges applied to the surface of the photoreceptor, that is, the charged potential on the surface of the photoreceptor, and a support member for supporting the electrode and the grid electrode. Since the grid electrode can control the charged potential on the surface of the photoreceptor substantially accurately, the charging apparatus provided with the grid electrode has become predominant at present. For the grid electrode, a wire grid electrode formed, for example, from stainless steel or tungsten, and a porous plate grid electrode in which a plurality of perforations are formed to a metal plate formed, for example, from stainless steel (grid substrate), etc are used.

As an electrode for use in the charging apparatus are used a wire electrode, a metal plate electrode having a plurality of needle portions (hereinafter referred to as "needle electrode"), etc. Among them, the needle electrode having advantages of requiring less number of constituent parts, having longer life, with less generation amount of ozone and with less failure because disconnection does not occur is preferably used. The needle electrode is manufactured by applying etching to a metal plate mainly formed, for example, from iron series metal material such as stainless steel to form a plurality of needle portions. The needle electrode manufactured by etching is also referred to as an etched electrode. Since the etched cross section of the needle electrode lacks in the smoothness and a plurality of edges for conducting discharge are present at the top end of the needle portion, as well as the shape of the edges present at the top ends of a plurality of needle portions is not uniform, discharging at each of the needle portions become not uniform. As a result, the charged potential on the surface of the photoreceptor can not be controlled sufficiently to make the charged potential not uniform on the surface of the photoreceptor.

Further, while the iron series metal material such as stainless steel as the material for the needle electrode has high durability, it involves a drawback to be oxidized easily due to water content under a high humidity circumstance and ozone generated by corona discharging during charging operation. Then, in the use of the needle electrode for a long time, use under the high humidity circumstance, contact with ozone, etc. are inevitable. Accordingly, in the needle electrode formed from a metal material such as stainless steel, corrosion occurs due to moisture in air and ozone to deteriorate the durability. In addition, the controlling performance for a high voltage applied to the needle electrode for generating corona discharge from the needle portion is lowered and the charged potential becomes not uniform on the surface of the photoreceptor to result in a problem to be solved that a desired charged potential can not always be applied stably to the surface of the photoreceptor.

Further, the wire electrode also involves a problem to be solved similar to that in the needle electrode that rust or corrosion occurs due to ozone generated by corona discharge and the charged potential on the surface of the photoreceptor becomes not uniform.

In view of the foregoing problems in the charging apparatus, it has been proposed, for example, a charging apparatus including a wire electrode extended in a shield case opened at one surface and a plate grid electrode arranged between the wire electrode and the photoreceptor, wherein the plate grid electrode is formed by applying a nickel plating layer of about 1 μm thickness on the surface of a porous stainless steel plate and forming a gold plating layer of about 0.3 μm thickness further thereon is provided (for example in JP-A 11-40316). In the plate grid electrode of JP-A 11-40316, since the gold plating layer is formed by way of the nickel plating layer, the gold plating layer is less peeled and the corrosion resistance and the controllability for the charged potential on the surface of the photoreceptor are relatively satisfactory. However, since manufacture of the plate grid electrode requires plating steps twice, i.e., nickel plating and gold plating, the manufacturing step is complicated to increase the cost. Further, it is necessary to form the gold metal layer to a thickness of 0.3 μm or more in order that the plate grid electrode can provide the preferred characteristics sufficiently. In addition, since the plate grid electrode is a relatively large member having a substantially the same size as the photoreceptor, the amount of gold to be used is necessarily increased also because of the necessity for increasing the thickness of the plating layer. However, use of gold in such a great amount unnecessarily increases the cost of the charging apparatus and, thus, impairs the general applicability of the image forming apparatus due to the relatively reduced cost, which is one of the advantages of the image forming apparatus. Accordingly, it has been demanded for a charging apparatus having the needle electrode and the plate grid electrode not using an expensive material such as gold and excellent in the durability and the controllability for the charged potential on the surface of the photoreceptor.

Further, JP-A 2001-166569, for example, also proposes a charging apparatus having a wire electrode and a plate grid electrode in which a gold plating layer is formed by an electrolytic plating method using a pulse current directly on the surface of the stainless steel metal plate similar to that in JP-A 11-40316. Also in this plate grid electrode, the gold plating layer hardly peels and, like the plate grid electrode in JP-A 11-40316, the corrosion resistance is high and the controllability for the charged potential on the surface of the photoreceptor is also favorable. However, since it is necessary to increase the thickness of the gold metal layer to 0.3 μm or more, also in the plate grid electrode, it involves the same drawback as in the charging apparatus of JP-A 11-40316.

On the other hand, it has also been proposed to coat gold on the side of the electrode (refer for example to Japanese Unexamined Patent Publication JP-A 2004-4334). The charging apparatus of JP-A 2004-4334 includes a needle electrode in which coating layers comprising gold, platinum, copper, nickel or chromium are formed by plating on the surface thereof. While a method of etching, precision pressing, etc. is used for forming the needle electrode, the cross section of the needle electrode obtained by the method lacks in smoothness and results in fine irregularities. Accordingly, even after applying the plating, fine irregularities on the cross section leaves as it is to disturb the balance of the corona discharge causing the charged potential not uniform on the surface of the photoreceptor. Further, contaminants such as a toner are tended to be deposited on the fine irregularities. That is, since the needle electrode of JP-A 2004-4334 suffers from contaminants such as the toner during long time use, which further makes the charged potential on the surface of the photoreceptor not uniform.

SUMMARY

A charging apparatus has high durability, being scarcely impaired in view of the controllability for the charged potential even when contaminant such as a toner are deposited more or less, capable of stably controlling the charged potential of the photoreceptor in an appropriate range for a long time, capable of easily removing deposited contaminants and being inexpensive, as well as an image forming apparatus including the charging apparatus and capable of recording images at high quality for a long time.

The technology provides a charging apparatus comprising:

an electrode for applying a voltage to a surface of a photoreceptor and charging the surface; and a grid electrode disposed between the electrode and the photoreceptor for controlling the charged potential on the surface of the photoreceptor, wherein the grid electrode has a nickel plating layer containing polytetrafluoroethylene on at least one surface of a porous plate grid substrate.

The charging apparatus includes an electrode for applying a voltage to a surface of a photoreceptor and a grid electrode disposed between the electrode and the photoreceptor for controlling the charged potential on the surface of the photoreceptor, and the grid electrode is used in which a nickel plating layer containing polytetrafluoroethylene (hereinafter referred to as "nickel PTFE composite plating layer" unless otherwise specified) is formed on the surface of the porous plate grid substrate. The grid electrode is excellent in the controllability for the charged potential on the surface of the photoreceptor, and can maintain the charged potential on the surface of the photoreceptor in an appropriate range. Further, the grid electrode has a high durability and the controllability for the charged potential described above can be provided stably for a long time. Accordingly, the image forming apparatus including the charging apparatus having the grid electrode can record images at high quality for a long time. Further, in the grid electrode, since only the nickel PTFE composite plating layer is formed, instead of the gold plating layer in the related arts, on the surface of the grid substrate, it has an advantage being less expensive compared with the plate grid in the related arts.

It is preferable that the nickel PTFE composite plating layer is formed by an electroless plating method.

Since the nickel PTFE composite plating layer of the grid electrode is formed by an electroless plating method, a nickel PTFE composite plating layer having dense and hard structure, less pinholes, uniform thickness although being thin and having close adhesion to the grid substrate compared with the nickel PTFE composite plating layer obtained by a usual electrolytic plating method by DC current can be obtained. The controllability for the charged potential and the durability of the grid electrode are further improved.

It is preferable that a thickness of the nickel PTFE composite plating layer is 0.3 μm or more.

The controllability for the charged potential of the grid electrode and the durability can be provided reliably by defining the thickness of the nickel PTFE composite plating layer to 0.3 μm or more in the grid electrode.

It is preferable that a nickel plating layer is further formed between the porous plate grid substrate and the nickel PTFE composite plating layer.

Peeling of the nickel PTFE composite plating layer from the grid substrate can be prevented further to improve the durability of the grid electrode further by forming a nickel plating layer between the grid substrate and the nickel PTFE composite plating layer in the grid electrode. Accordingly, a charging apparatus capable of stably controlling the charged potential on the surface of the photoreceptor for a longer period of time can be obtained.

It is preferable that the nickel PTFE composite plating layer contains phosphorus together with nickel as a plating ingredient.

Close adhesion of the plating layer to the grid substrate is improved to further improve the durability of the grid electrode since the nickel PTFE composite plating layer contains nickel together with phosphorus as a plating ingredient in the grid electrode.

It is preferable that the porous plate grid substrate is a porous stainless steel sheet or porous copper sheet.

A porous stainless steel sheet and a porous copper sheet are preferred as a porous plate grid substrate for forming the grid electrode. In the case where the porous stainless steel sheet is used, since the controllability for the charged potential on the surface of the photoreceptor is extremely favorable and, in addition, occurrence of corrosion such as rust and deposition of nitrogen oxides are decreased extremely, the durability is further improved. While the porous copper sheet is inexpensive, it has a drawback that the corrosion resistance is insufficient. However, by applying the nickel PTFE composite plating, the corrosion resistance is improved to a satisfactory level. In addition, since the porous copper sheet has extremely high close adhesion with the nickel PTFE composite plating layer and it is not necessary to form the nickel PTFE composite plating layer by way of a nickel plating layer, the number of steps upon manufacture can be decreased to save the manufacture cost. Accordingly, use of the porous copper sheet can decrease the occurrence of corrosion such as rust and deposition of silicon oxides and can obtain a grid electrode excellent in the durability, satisfactory in the controllability for the charged potential on the surface of the photoreceptor and reduced in the cost.

Further, an image forming apparatus comprises:

a photoreceptor having a surface on which an electrostatic latent image is formed;

the charging apparatus mentioned above for charging the surface of the photoreceptor;

exposure means for irradiating the surface of the photoreceptor in the charged state with a signal light based on the image information to form an electrostatic latent image;

developing means for developing the electrostatic latent image formed on the surface of the photoreceptor to form a toner image;

transfer means for transferring the toner image to a recording material; and] fixing means for fixing the toner image transferred to the recording material.

Since the charged potential on the surface of the photoreceptor can be maintained stably in an appropriate range upon forming an electrostatic latent image by using the charging apparatus having the grid electrode in which the nickel PTFE composite plating layer is formed on the surface of the porous plate grid substrate as the charging apparatus in the image forming apparatus including the photoreceptor, the charging apparatus, the exposure means, the developing means, the transfer means and the fixing means, an image at high quality can be recorded for a long time and an image forming apparatus of a reduced cost can be obtained since it has no gold plating layer as in the related arts.

Further, it is preferable that the image forming apparatus further comprises:

surface potential detection means for detecting a surface potential on the photoreceptor; and charge control means for controlling an amount of current supplied to the charging apparatus and/or the grid voltage applied to the grid electrode in accordance with a result of detection obtained by the surface potential detection means.

Since the surface potential detection means and the charge control means are provided in the image forming apparatus, the potential for the surface of the photoreceptor is detected by the surface potential detection means and the charging current supplied to the charging apparatus and the grid voltage applied to the grid electrode are controlled in accordance with the result of the detection, the charged potential on the surface of the photoreceptor can be made further uniform and stable and an image at high quality can be recorded with no troubles for further longer time.

A charging apparatus comprises:

an electrode having a plurality of pointed protrusions for applying a voltage to a surface of the photoreceptor and charging the surface; and a grid electrode disposed between the electrode and the photoreceptor for controlling the charged potential on the surface of the photoreceptor, wherein a nickel PTFE composite plating layer is formed on at least one surface of the electrode.

A charging apparatus comprises a needle electrode which is a plate electrode having a plurality of pointed protrusions, for applying a voltage to the surface of the photoreceptor (hereinafter referred to as "needle electrode"), in which a nickel PTFE composite plating layer is formed on the surface, and a grid electrode disposed between the needle electrode and the photoreceptor for controlling the charged potential on the surface of the photoreceptor. The needle electrode is excellent in the corrosion discharging property to the surface of the photoreceptor and capable of controlling the charged potential on the surface of the photoreceptor within an appropriate range and uniformly by the structural feature thereof that the needle electrode has a plurality of pointed protrusions and the surface is covered with a nickel PTFE composite plating layer. Further, the needle electrode has high durability and can provide the charged potential controllability for a long time stably. Further, since the nickel PTFE composite metal layer is covered on the surface of the needle electrode, contaminants such as a toner deposited on the surface can be removed easily by usual cleaning means. Accordingly, the image forming apparatus including the charging apparatus having the needle electrode can record the images at high quality for a long time. Further, since only the nickel plating layer containing polytetrafluoroethylene is formed, instead of the gold plating layer as in the related art, on the surface of the substrate, in the needle electrode, it has an advantage of being less expensive compared with the needle electrode in the related art.

It is preferable the nickel PTFE composite plating layer is formed by an electroless plating method.

Since the nickel PTFE composite plating layer of the needle electrode is formed by an electroless plating method, a nickel PTFE composite plating layer having dense and hard structure, less pinholes, uniform thickness although being thin and having close adhesion to the needle electrode compared with the nickel PTFE composite plating layer obtained by a usual electrolytic plating method by DC current can be obtained. Since this makes the roughened cross section smooth, the controllability for the charged potential and the durability of the needle electrode plate are further improved. Furthermore, contaminants such as the toner are less deposited.

It is preferable that a thickness of the nickel PTFE composite plating layer is 0.3 μm or more.

The controllability for the charged potential of the needle electrode plate and the durability can be provided reliably by defining the thickness of the nickel PTFE composite plating layer to 0.3 μm or more in the needle electrode plate.

It is preferable that a nickel plating layer is further formed between the electrode and the nickel PTFE composite plating layer.

Peeling of the nickel PTFE composite plating layer from the needle electrode substrate can be prevented further to improve the durability as the needle electrode further by forming a nickel plating layer between the needle electrode substrate and the nickel PTFE composite plating layer in the needle electrode. Accordingly, a charging apparatus capable of stably controlling the charged potential on the surface of the photoreceptor for a longer period of time can be obtained.

It is preferable that the nickel PTFE composite plating layer contains phosphorus together with nickel as a plating ingredient.

Close adhesion of the plating layer to the needle electrode substrate is improved to further improve the durability as the needle electrode plate since the nickel PTFE composite plating layer contains nickel together with phosphorus as a plating ingredient in the needle electrode.

Further, an image forming apparatus comprises:

a photoreceptor having a surface on which an electrostatic latent image is formed;

the charging apparatus mentioned above for charging the surface of the photoreceptor;

exposure means for irradiating the surface of the photoreceptor in a charged state with a signal light based on the image information to form an electrostatic latent image;

developing means for developing the electrostatic latent image formed on the surface of the photoreceptor to form a toner image;

transfer means for transferring the toner image to a recording material; and fixing means for fixing the toner image transferred to the recording material.

Since the charged potential on the surface of the photoreceptor can be maintained stably in an appropriate range upon forming electrostatic latent images by using the charging apparatus having the needle electrode in which the nickel PTFE composite plating layer is formed on the surface as the charging apparatus in the image forming apparatus including the photoreceptor, the charging apparatus, the exposure means, the developing means, the transfer means and the fixing means, an image at high quality can be recorded for a long time and an image forming apparatus of a reduced cost can be obtained since it has no gold plating layer as in the related arts.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
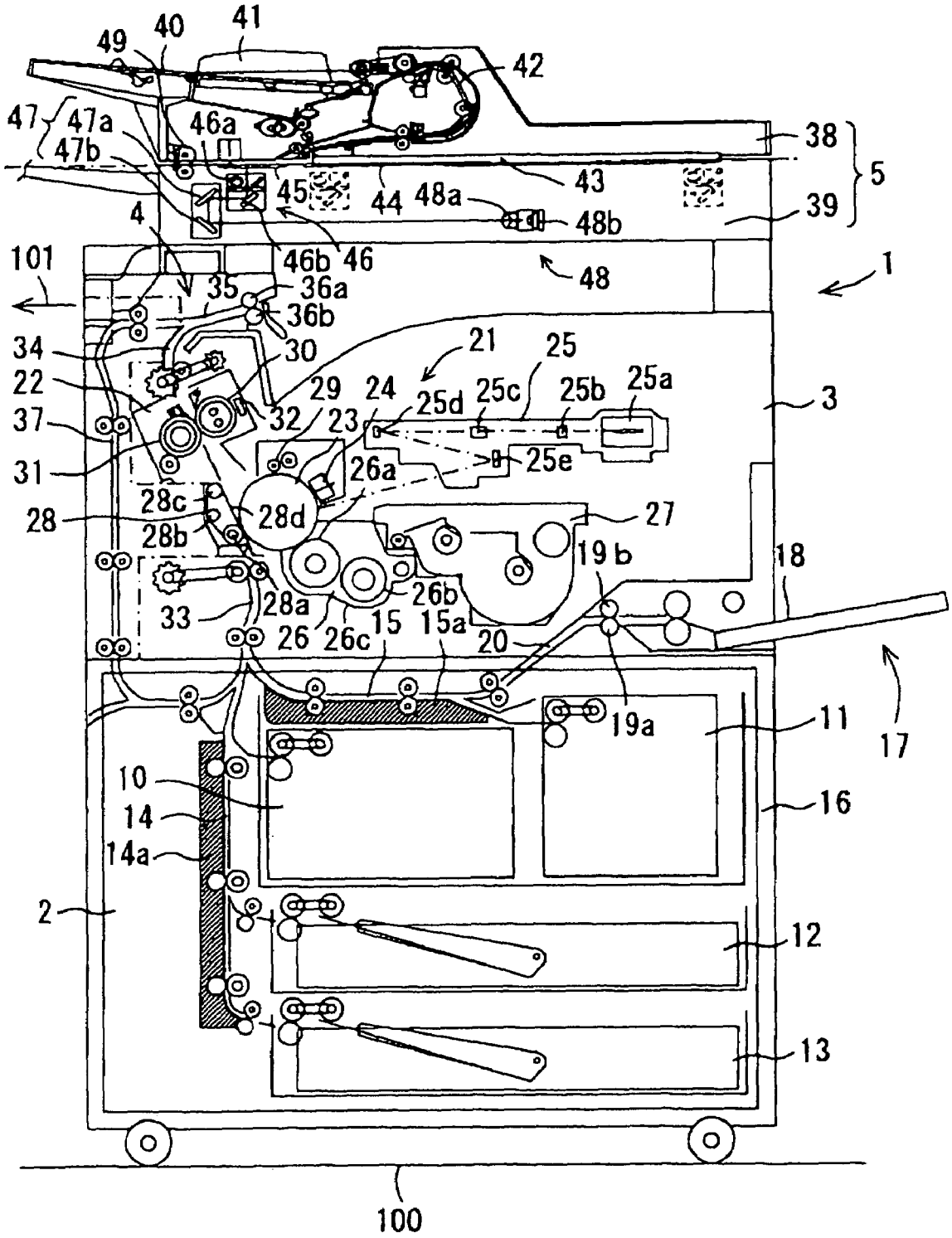
FIG. 1 is a cross sectional view schematically showing the constitution of an image forming apparatus according to an example embodiment.

Now referring to the drawings, preferred example embodiments are described below.

FIG. 1 is a cross sectional view schematically showing the constitution of an image forming apparatus 1 according to an example embodiment.

An image forming apparatus 1 is a multifunctional machine having a copying function, a printer function and a facsimile function together. That is, the image forming apparatus 1 has three types of copier mode (copying mode), printer mode and FAX mode and the printing mode is selected by a control portion (not shown) depending on the operation input from an operation portion (not shown), reception of the printing job from an external host apparatus such as a personal computer.

The image forming apparatus 1 includes a paper feeding unit station 2 for storing recording media and feeding the recording media to an image forming station 3 to be described later, an image forming station 3 forming images on recording media, a paper discharging station 4, and a document reading station 5 for reading images and/or letters described on a copy document, converting the information into electric signals and transmitting them to the image forming station 3.

The paper feeding unit 2 includes paper feed trays 10, 11, 12, and 13 for containing recording media such as recording paper or OHP, first and second conveying channels 14, 15 for conveying the recording media contained in the paper feed trays 10 to 13 to the image forming station 3, a frame 16 for containing and protecting the paper feed trays 10 to 13, and the first and second conveying channels 14, 15, and a manual feeding station 17 disposed above the frame 16.

The paper feed trays 10 to 13 can contain recording media different from one another in the size and/or kind. The size means herein, for example, the size of A3, A4, B4, and B5 according to JIS P 0138 or JIS P 0202. Further, they can also contain recording media of indefinite sizes not limited to the sizes described above. On the other hand, the kind of media means recording paper such as plain paper and color copy paper, and OHP film. Of course, the paper feed trays 10 to 13 can contain recording media of identical size and identical kind.

The paper feed trays 10, 11 are arranged in parallel with each other, a paper feed tray 12 is disposed therebelow and, further, a paper feed tray 13 is disposed further therebelow. The recording media are supplemented to the paper feed trays 10 to 13 by drawing paper feed trays 10 to 13 on the frontal side of the image forming apparatus (operation side).

The first conveying channel 14 is disposed so as to extend along the frame 16 of the paper feed unit 2 in a substantially vertical direction which is a direction perpendicular to the installation plane 100 of the image forming apparatus 1 and feeds the recording media contained in the paper feed trays 10, 12, and 13 to the image forming station 3. Further, the second conveying channel 15 is disposed along the frame of the paper feed unit 2 so as to extend substantially in a horizontal direction which is a direction parallel with the installation plane 100 of the image forming apparatus and feeds the recording media contained in the paper feed tray 11 to the image forming station 3.

As described above, in the frame 16 of the paper feed unit 2, the paper feed trays 10 to 13 and the first and the second conveying channels 14 and 15 are arranged efficiently to attain space saving.

The manual feed station 17 is disposed above the frame 16 and includes a manual feed tray 18, paper feed rollers 19*a*, 19*b* for intaking the recording media supplied to the manual feed tray 18 to the inside of the image forming apparatus 1, and a manual feed channel 20 disposed so as to be connected with the second conveying channel 15 and feeling the recording media intaken by the paper feed rollers 19*a* and 19*b* to the inside of the image forming apparatus 1 to the image forming station 3.

The manual feed tray 18 is fixed to the upper side of the frame 16 in the inside of the image forming apparatus 1 and disposed such that a portion thereof protrudes from the lateral surface 1*a* to the outside of the image forming apparatus 1. Further, the manual feed tray 18 can be contained inside the image forming apparatus 1. Further, the recording media are fed from the manual feed tray 18 to the inside of the image forming apparatus 1.

The paper feed rollers 19*a*, 19*b* are in press contact with each other and disposed such that they can be driven rotationally around the axis by driving means (not shown) respectively. The recording media fed from the manual feed tray 18 to the press contact portion of the paper feed rollers 19*a*, 19*b* are sent by the rotational driving to the paper feed rollers 19*a*, 19*b* to the manual feed channel 20.

The manual feed channel 20 is disposed so as to pass through the frame 16 and be connected with the second conveying channel 15. The recording media sent by the paper feed rollers 19*a*, 19*b* to the manual feed channel 20 are pass through the second conveying channel 15 and fed to the image forming station 3.

By the manual feed station 17, the recording media supplied from the manual feed tray 16 are sent by the paper feed rollers 19*a*, 19*b* to the manual feed channel 20 and, further, by way of the second conveying channel 15 to the image forming station 3.

In the paper feed unit 2, in a case of forming images to a recording medium, a tray in which recording medium of previously designated size and kind are contained is selected from the paper feed trays 10 to 13, recording media are separated one by one from the tray, the separated recording medium is fed by way of any one of the first conveying channel 14 and the second conveying channel 15 to the image forming station 3 to conduct image formation. Alternatively, the recording medium supplied from the manual feed station 17 is sent in the same manner to the image forming station 3 to conduct image formation.

The image forming station 3 includes an electrophotographic processing station 21 for transferring toner images formed corresponding to the image data to a recording medium, and a fixing station 22 that is fixing means for fixing toner images transferred on the recording medium in the electrophotographic processing station 21 to the recording medium.

The electrophotographic processing station 21 includes a photoreceptor drum 23 that is a photoreceptor, a charging apparatus 24, an optical scanning unit 25 that is exposure means, a development unit 26 that is developing means, a developer storing unit 27, a transfer unit 28 that is transfer means, and a cleaning unit 29.

The photoreceptor drum 23 is supported such that it can be driven rotationally around an axis by driving menas (not shown) and includes a conductive substrate (not shown) in cylindrical, circular columnar shape or in the form of thin film sheet, preferably, cylindrical conductive substrate, and a photosensitive layer formed on the surface of the conductive substrate.

For the conductive material as the material of the conductive substrate, those customarily used in the relevant field can be used including, for example, metals such as aluminum, copper, brass, zinc, nickel, stainless steel, chromium, molybdenum, vanadium, indium, titanium, gold, platinum, alloys comprising two or more of them, a conductive film obtained by forming a conductive layer comprising one or more of aluminum, aluminum alloy, tin oxide, gold, indium oxide, etc on a film-like substrate such as of synthetic resin film, metal film, and paper, resin compositions containing conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, a undercoat layer is preferably formed between the conductive substrate and the charge generating layer or the charge transporting layer. Provision of the undercoat layer can provide a merit of covering the injury and irregularities present on the surface of the conductive substrate to smooth the surface of the photosensitive layer, preventing degradation of the chargeability of the photosensitive layer during repetitive use and improving the charging property of the photosensitive layer under a low temperature and/or low humidity circumstance.

The charge generating layer contains a charge generating substance that generates charges under irradiation of light as a main ingredient and, optionally, known binder resin, plasticizer, sensitizer, etc. As the charge generating substance those used customarily in the relevant field can be used and includes, for example, perylene pigments such as perylene imide and perylenic acid anhydride, polynuclear quinone pigments such as quinacridone and anthraquinone, phthalocyanine pigments such as metal and non-metal phthalocyanines, halogenated non-metal phthalocyanines, squalium dyes, azulenium dyes, thiapylirium dyes, and azo pigments having carbazole skeleton, strylstylbene skeleton, triphenylamine skeleton, dibenzothiophene skeleton, oxadiazole skeleton, fluorenone skeleton, bisstylbene skeleton, distyryloxadiazole skeleton, or distyryl carbazole skeleton Among them, non-metal phthalocyanine pigments, oxotitanyl phthalocyanine pigments, bisazo pigments containing fluorene rings and/or fluorenone rings, bisazo pigments comprising aromatic amines, and tris azo pigments have high charge generation ability and are suitable for obtaining a light sensitive layer at high sensitivity. The charge generating substance can be used alone or two or more of the materials can be used in combination. While the content of the charge generating substance is not particularly restricted, it is, preferably, from 5 to 500 parts by weight and, more preferably, from 10 to 200 parts by weight based on 100 parts by weight of a binder resin in the charge generating layer.

Also for the binder resin for the charge generating layer, those used customarily in the relevant field can be used and include, for example, melamine resin, epoxy resin, silicon resin, polyurethane, acryl resin, vinyl chloride-vinyl acetate copolymer resin, polycarbonate, phenoxy resin, polyvinyl butyral, polyallylate, polyamide, and polyester. The binder resin can be used alone or, optionally, two or more of the resins can be used in combination.

The charge generating layer can be formed by dissolving or dispersing a charge generating substance, a binder resin and, optionally, a plasticizer, a sensitizer, etc. each in an appropriate amount in an appropriate organic solvent capable of dissolving or dispersing the ingredients described above to prepare a coating solution for charge generating layer, and coating the coating solution for charge generating layer on the surface of a conductive substrate, followed by drying. While the thickness of the charge generating layer obtained in this way is not particularly restricted, it is, preferably, from 0.05 to 5 μm and, more preferably, from 0.1 to 2.5 μm.

The charge transporting layer stacked over the charge generating layer contains a charge transporting substance having a performance capable of receiving and transporting charges generated from the charge generating substance, a binder resin for the charge transporting layer as essential ingredients and, optionally, known antioxidant, plasticizer, sensitizer, lubricant, etc. As the charge transporting substance, those used customarily in the relevant field can be used and include, for example, electron donating materials such as poly-N-vinyl carbazole and derivatives thereof, poly-γ-carbazolyl ethyl glutamate and derivatives thereof, pyrene-formaldehyde condensation product and derivatives thereof, polyvinylpyrene, polyvinyl phenanthrene, oxazole derivatives, oxadiazole derivatives, imidazole derivatives, 9-(p-diethylaminostyryl)anthracene, 1,1-bis(4-dibenzylaminophenyl)propane, styrylanthracene, styrylpyrazoline, pyrazoline derivatives, phenyl hydrazones, hydrazone derivatives, triphenylamine compounds, tetraphenyldiamine compounds, triphenylmethane compounds, stylbene compounds, and azine compound having 3-methyl-2-benzothiazoline ring, and electron accepting materials such as fluorenone derivatives, dibenzothiophene derivatives, indenothiopnene derivatives, phenanthrenequinone derivatives, indenopyridine derivatives, thioquisantone derivatives, benzo[c]cinnoline derivatives, phenazine oxide derivatives, tetracyanoethylene, tetracyanoquinodimethane, promanyl, chloranyl, and benzoquinone. The charge transporting substance can be used alone or two or more of the materials can be used in combination. While the content of the charge transporting substance is not particularly restricted, it is, preferably, from 10 to 300 parts by weight and, more preferably, from 30 to 150 parts by weight based on 100 parts by weight of the binder resin in the charge transporting substance.

As the binder resin for charge transporting layer, those used customarily in the relevant field and capable of uniformly dispersing the charge transporting substance can be used and includes, for example, polycarbonate, polyallylate, polyvinylbutyral, polyamide, polyester, polyketone, epoxy resin, polyurethane, polyvinylketone, polystyrene, polyacrylamide, phenol resin, phenoxy resin, polysulfone resin, and copolymer resins thereof. Among them, in view of the film forming property, and the wear resistance and the electrical characteristics of the obtained charge transporting layer, polycarbonate containing bisphenol Z as the monomer ingredient (hereinafter referred to as "bisphenol Z polycarbonate"), and mixture of bisphenol Z polycarbonate and other polycarbonate are preferred. The binder resin can be used alone or two or more of the resins can be used in combination.

The charge transporting layer preferably contains an antioxidant together with the charge transfer material and the binder resin for charge transporting layer. Also for the antioxidant, those used customarily in the relevant field can be used and include, for example, Vitamin E, hydroquinone, hindered amine, hindered phenol, paraphenylene diamine, arylalkane and derivatives thereof, organic sulfur compounds, organic phosphorus compounds, etc. The antioxidant can be used alone or two or more of the antioxidants can be used in combination. While the content of the antioxidant is not particularly restricted, it is from 0.01 to 10% by weight and, preferably, from 0.05 to 5% by weight based on the total amount of the ingredients constituting the charge transporting layer.

The charge transporting layer can be formed by dissolving or dispersing a charge transporting substance, a binder resin, and, optionally, an antioxidant, a plasticizer, a sensitizer, etc. each in an appropriate amount in an appropriate organic solvent capable of dissolving or dispersing the ingredients described above to prepare a coating solution for charge transporting layer, and coating the coating solution for charge transporting layer on the surface of a charge generating layer followed by drying. While the thickness of the charge transporting layer obtained in this way is not particularly restricted, it is, preferably, from 10 to 50 μm and, more preferably, from 15 to 40 μm.

A photosensitive layer in which a charge generating substance and a charge transporting substance are present in one layer can also be formed. In this case, the kind and the content of the charge generating substance and the charge transporting substance, the kind of the binder resin, and other additives may be identical with those in a case of forming the charge generating layer and the charge transporting layer separately.

While this embodiment uses a photoreceptor as a photoreceptor drum 23 in which an organic photosensitive layer using the charge generating substance and the charge transporting substance as described above is formed, a photoreceptor in which an inorganic photosensitive layer using silicon or the like is formed can also be used instead.

Figure 2:
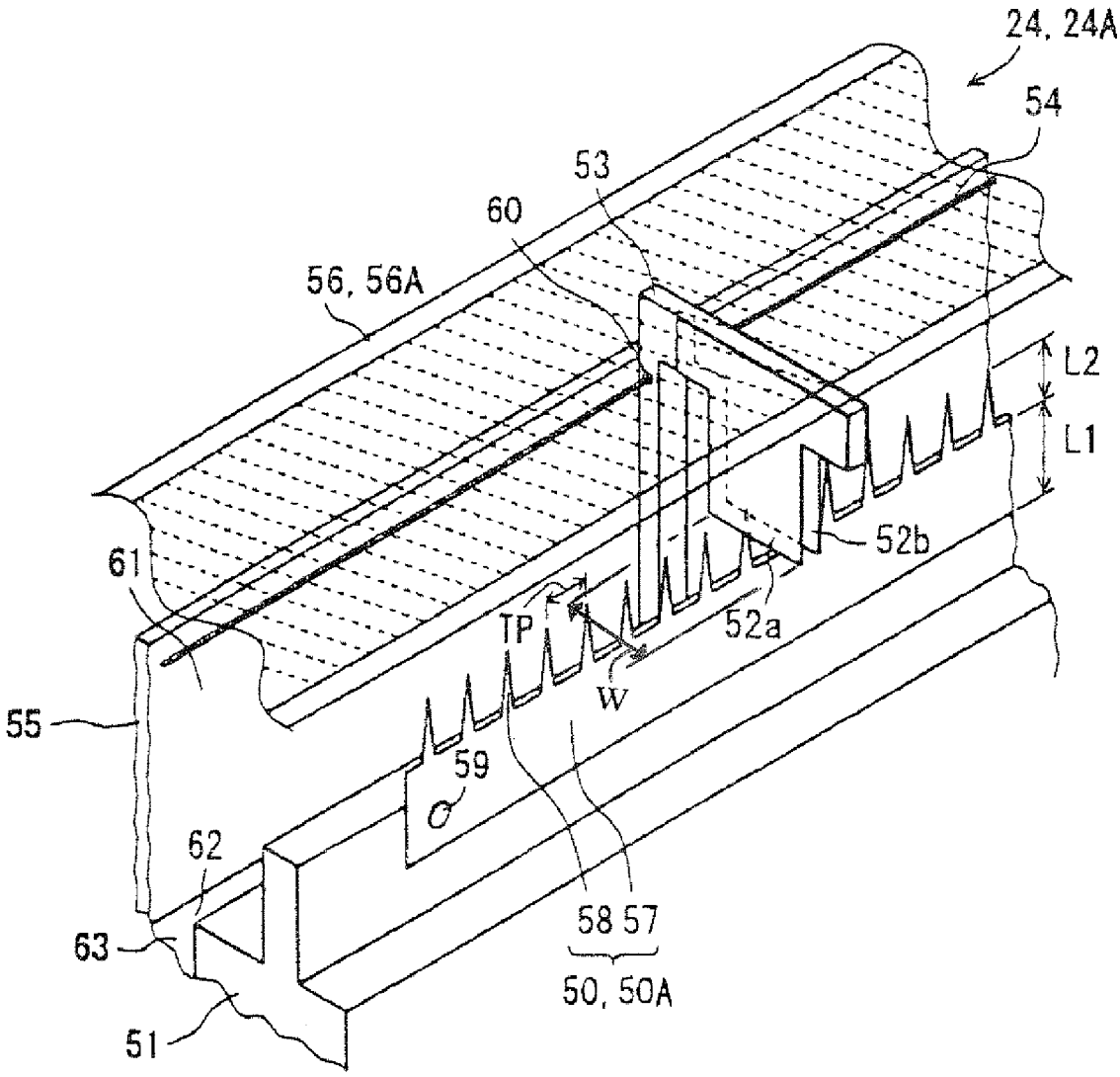
FIG. 2 is a perspective view schematically showing the constitution of a charging apparatus according to another example embodiment.
Figure 3:
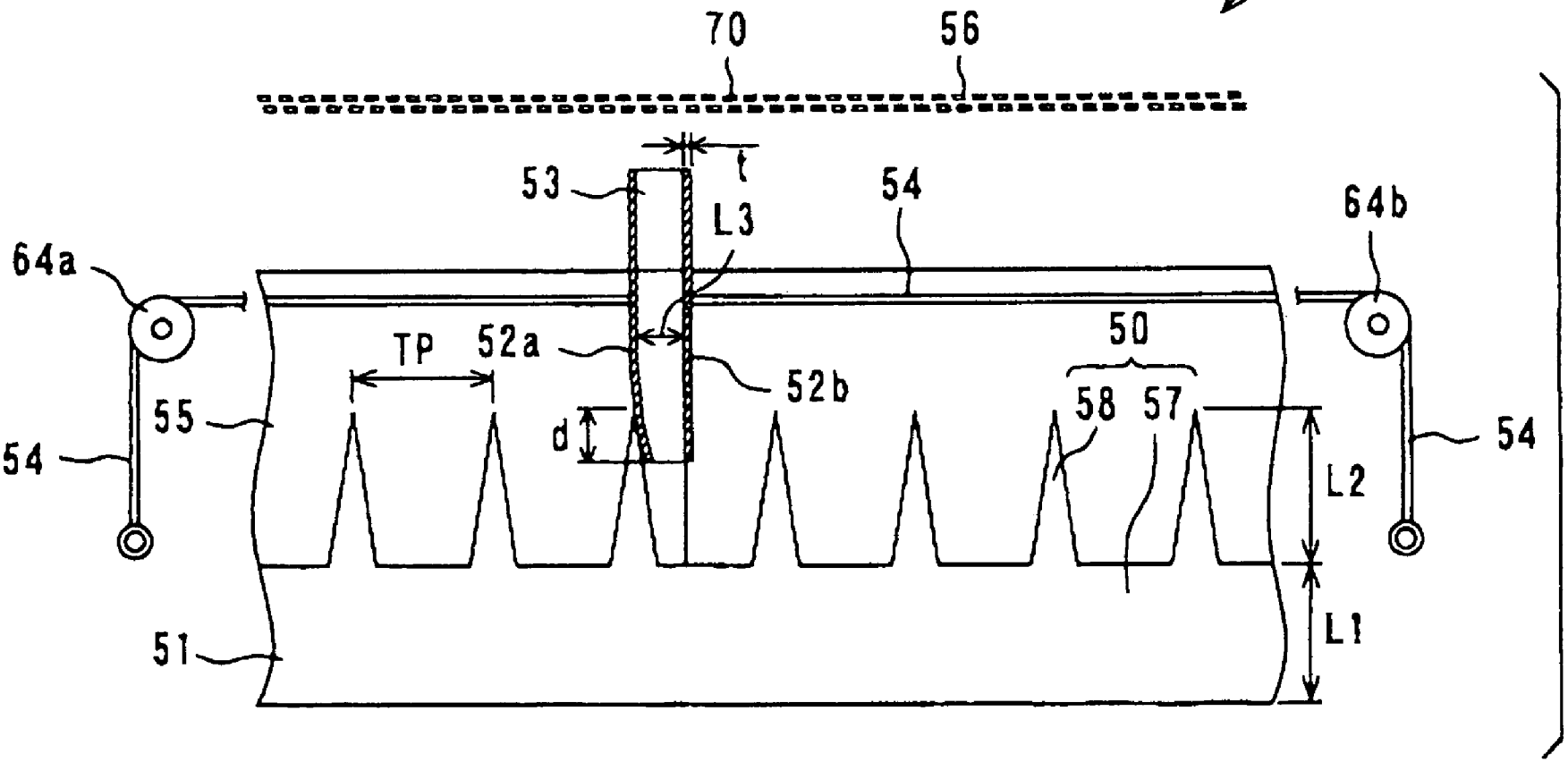
FIG. 3 is a front elevational view of the charging apparatus shown in FIG. 2.
Figure 4:
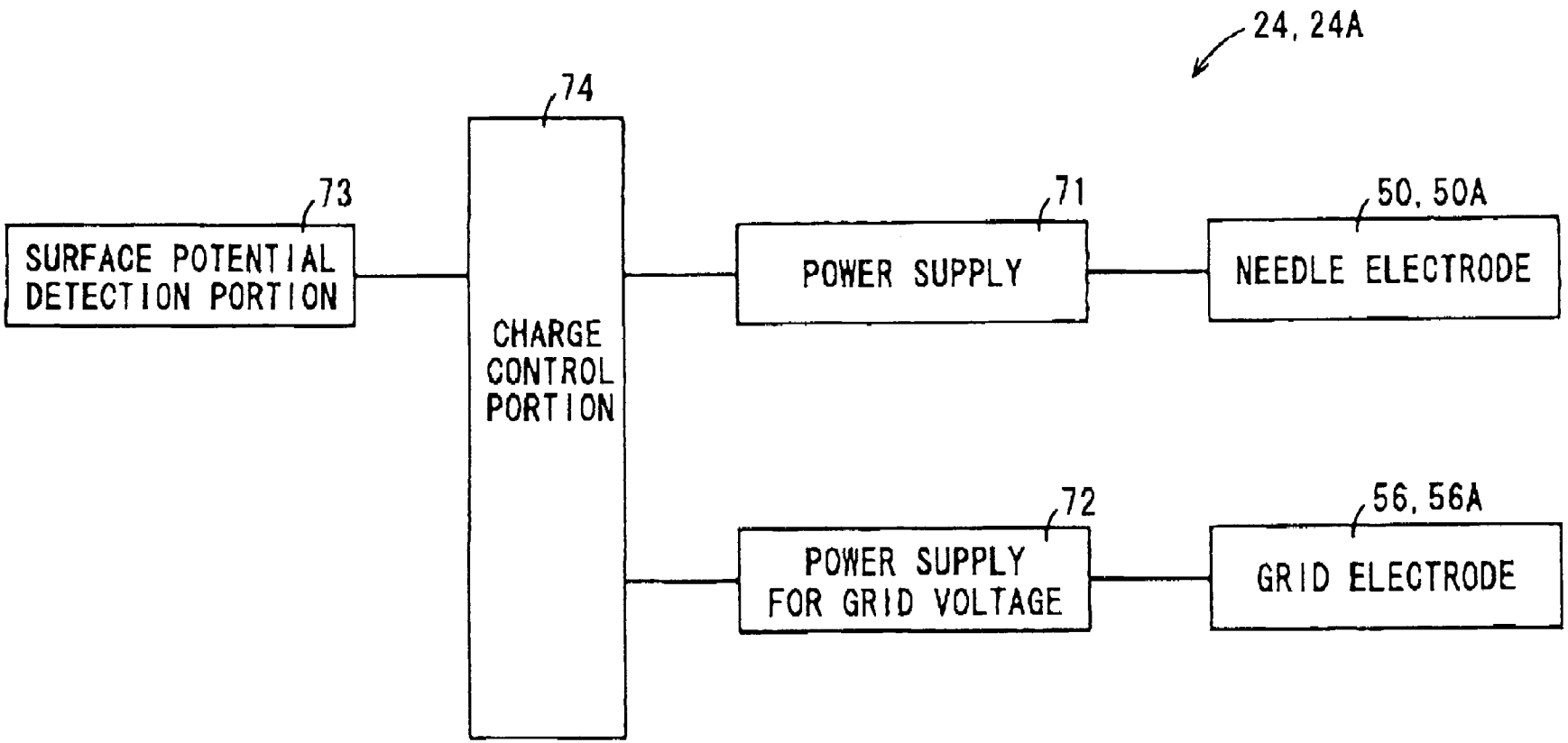
FIG. 4 is a block diagram showing an electrical configuration of the charging apparatus.

FIG. 2 is a perspective view schematically showing the constitution of the charging apparatus 24. FIG. 3 is a front elevational view of the charging apparatus 24 shown in FIG. 2. FIG. 4 is a block diagram showing an electrical configuration of the charging apparatus 24. The charging apparatus 24 includes a plate electrode 50 having a plurality of pointed protrusions 58 (hereinafter referred to as "needle electrode 50"), a holding member 51 for holding the needle electrode 50, two cleaner members 52*a*, 52*b* disposed relatively moveably to the needle electrode 50 for cleaning the surface of the needle electrode 50 by frictionally rubbing the needle electrode 50 upon movement, a support member 53 for supporting the cleaner members 52*a*, 52*b*, a moving member 54 for moving the cleaner members 52*a*, 52*b* and the support member 53, a shield case 55 for containing the needle electrode 50, the holding member 51, the cleaner members 52*a*, 52*b*, and the support member 53, and a grid electrode 56 for controlling the charged potential on the surface of the photoreceptor drum 23. The charging apparatus 24 is disposed facing the photoreceptor drum 23 along the longitudinal direction of the photoreceptor drum 23 in the electrophotographic processing station 21.

With reference to FIG. 4, the charging apparatus 24 includes a power supply 71, a power supply for grid voltage 72, a surface potential detection portion 73 that is surface potential detection means and a charge control portion 74 that is charge control means. The power supply 71 applies a voltage to the needle electrode 50. The power supply for grid voltage 72 applies a voltage to the gird electrode 56. The surface potential detection portion 73 detects the surface potential on the photoreceptor drum 23. The charge control portion 74 controls the amount of current supplied from the power supply 71 to the charging apparatus and/or the grid voltage applied from the power supply for gird voltage 72 to the grid electrode 56 in accordance with the result of detection obtained by the surface potential detection portion 73.

The needle electrode 50 is a thin plate member, for example, made of stainless steel which is constituted by a flat plate 57 extending longitudinally in one direction and pointed protrusions 58 formed so as to protrude from one end face of the flat plate 57 in the shorter direction. Referring, for example, to the size of the needle electrode 50, the length L1 in the shorter length of the flat plate 57 is preferably about 10 mm, the length L2 in the protruding direction of the protrusion 58 is preferably about 2 mm, the radius of curvature R at the top end of the protrusion 58 is preferably about 40 μm and the pitch TP at which the protrusions 58 are formed is preferably about 2 mm.

The holding member 51 holding the needle electrode 50 is a member, like the needle electrode 50, extending longitudinally in one direction having an inverted T cross sectional shape in perpendicular to the longitudinal direction and it is made, for example, from a resin. The needle electrode 50 is screw coupled by a thread member 59 near both longitudinal ends thereof to one lateral side of a protruded portion of the holding member 51. For charging the photoreceptor drum 23, a voltage at about 5 kV is applied from the power supply 71 for generating corona discharge to the needle electrode 50 during operation. A voltage is applied to the needle electrode 50 from the power supply 71, and corona discharge occurs from the pointed protrusions 58 to the surface of the photoreceptor drum 23 by the application of the voltage to charge the surface of the photoreceptor drum 23.

Each of the cleaning members 52*a*, 52*b* has a plate-like shape, more specifically, a T-shaped configuration when projected on a plane and comprises an elastic body of a metal material or a polymeric material with a thickness t of from 20 to 40 μm. In the case where the thickness t is less than 20 μm, while the member is easily deformed upon a butting against the needle electrode 50, since the pressing force to the needle electrode 50 as a reaction accompanied to the deformation, contaminants deposited to the needle electrode 50 can not be removed sufficiently. In the case where the thickness t exceeds 40 μm, while the contaminants deposited to the needle electrode 50 can be removed sufficiently, since the rigidity is increased and the pressing force to the needle electrode 50 is excessively increased, the top end of the protrusion 58 of the needle electrode 50 may possibly be fractured by deformation. As a result, in the case where the thickness t is out of the range of 20 to 40 μm, image unevenness due to charging failure, etc. may possibly be caused. As the metal material constituting the cleaner members 52*a*, 52*b*, phosphor bronze, ordinary steel, stainless steel, etc. can be used. Among them, stainless steel is preferred with a view point of the duration life due to anti-oxidation property while considering that the cleaner members 52*a* and 52*b* are used in the atmosphere of ozone generated by corona discharge. For the stainless steel, those heretofore known can be used including, for example, SUS304 as austenitic stainless steel and SUS430 as ferritic stainless steel which are defined by Japanese Industrial Standard (JIS) G4305.

The hardness of the cleaner members 52*a*, 52*b* is preferably 115 or more by Rockwell hardness M scale according to American Society for Testing and Materials Standards (ASTM) D785. In the case where the Rockwell hardness is less than 115, since the material is excessively soft, the cleaner members 52*a*, 52*b* are deformed excessively than required when they abut against and frictionally rub the needle electrode 50 failing to obtain the cleaning effect. Since no particular problem occurs in view of the function in the case where the hardness of the clearer members 52*a*, 52*b* is high, it is not necessary to define the upper limit. However, since the upper limit value in the Rockwell hardness M scale is 130, the upper limit, if defined, is 130.

The lateral size w of the cleaner members 52*a*, 52*b* in the longitudinal rod portion of the T-shape which is a portion abutting against the needle electrode 50, that is, the size w of the cleaner members 52*a*, 52*b* in the direction vertical to the moving direction of the cleaner members 52*a*, 52*b* and in the direction vertical to the extending direction of the protrusion 58 is preferably formed to 3.5 mm or more. In the case where the lateral size w is less than 3.5 mm, since the value per unit area of a force caused upon deformation being pressed by the needle electrode 50 increases, it tends to cause fatigue fracture to the repetitive deformation, to deteriorate the duration life. While the value per unit area of the force described above can be decreased to extend the duration life against the repetitive deformation by making the lateral size w to 3.5 mm or more, since the rigidity is excessively increased and the size of the device is enlarged in the case where the width is excessively large, the upper limit is preferably set to about 10 mm.

The cleaner members 52*a*, 52*b* and the needle electrode 50 are preferably arranged such that the intrusion amount of the protrusion 58 of the needle electrode 50 to the cleaner members 52*a*, 52*b* is from 0.2 to 0.8 mm. The intrusion amount d means overlap length between the cleaner members 52*a*, 52*b* and the protrusion 58 in the extending direction of the protrusion 58 in a state of projecting an imaginal plane to the moving direction of the cleaner members 52*a*, 52*b* relative to the needle electrode 50. In the case where the intrusion amount d is less than 0.2 mm, since the pressing force of the cleaner members 52*a*, 52*b* to the needle electrode 50 as the reaction accompanying the deformation of the members is weakened, contaminants deposited to the needle electrode 50 can not be removed sufficiently. In the case where the intrusion amount d exceeds 0.8 mm, while the contaminants deposited to the needle electrode 50 can be removed sufficiently, since the reaction accompanying the deformation of the cleaner members 52*a*, 52*b* (pressing force to the needle electrode 50) is excessively increased, the top end of the protrusion 58 of the needle electrode 50 may possibly be fractured by deformation. As a result, in the case where the intrusion amount d is out of the range from 0.2 to 0.8 mm, unevenness in the images due to charging failure, etc. may possibly be caused.

The support member 53 is a member having an inverted L-shaped configuration for supporting the cleaner members 52*a*, 52*b* and arm portions of the cleaner members 52*a*, 52*b* in the T-shaped configuration are attached to the beam portion. The two cleaner members 52*a*, 52*b* are disposed so as to have a predetermined gap L3 with regard to the direction moving relatively to the needle electrode 50. The gap L3 is selected to such a distance such that when one cleaner member 52*a* is deformed being abutted against the needle electrode 50, the other cleaner member 52*b* is not in contact with the deformed cleaner member 52*a*, and this is adjustable by the thickness of the beam portion of the support member 53 for attachment. Since the state of deformation changes depending on the material constituting the cleaner members 52*a*, 52*b*, the gap L3 is preferably decided by previously testing the deformed state of the material. In the case where each of the cleaner members 52*a*, 52*b* is made, for example, of a stainless steel at a thickness t=30 μm, the gap L3 is preferably 2 mm. By the provision of the gap L3 between the two cleaner members 52*a* and 52*b*, during frictional rubbing of the needle electrode 50 by one cleaner member 52*a*, since a pressing force can be maintained in a preferred range with no hindrance for the deformation by the other cleaner member 52*b*, the needle electrode 50 can be cleaned sufficiently with no deformation injury for the top end thereof.

The shield case 55 is made, for example, of stainless steel which is a container-like member in a rectangular parallelepiped outer shape having an inner space and having an opening at one surface facing the photoreceptor drum 23. Further, the shield case 55 extends longitudinally in the identical direction with the needle electrode 50 and has a substantially U-shaped cross sectional configuration in the direction perpendicular to the longitudinal direction. Further, a holding member 51 is attached to the bottom 63 of the shield case 55. Further, the end of a columnar portion of the support member 53 is inserted slidably to a groove 62 formed with the inner lateral surface 61 of the shield case 55 and the holding member 51.

A through hole 60 is formed to the columnar portion of the support member 53 in parallel with the extending direction of the needle electrode 50, and the moving member 54 is disposed being inserted through the through hole 60. Since the moving member 54 is fixed to the support member 53 at the portion inserted through the through hole 60, the support member 53 moves slidably to the groove 62 by tracking the moving member 54 in the extending direction of the needle electrode 50, and can move in the extending direction of the needle electrode 50 by being guided by the groove portion 62. That is, the cleaner members 52*a*, 52*b* supported by support member 53 can be abutted against and frictionally rub the needle electrode 50.

The moving member 54 is a thread-like or wire-like member and disposed being inserted through the through hole 60 formed in the columnar portion of the support member 53 in parallel with the extending direction of the needle electrode 50, extends from a hole or a gap formed in the shield case 55 to the outside of the shield case 55, and the end is suspended by way of the outer surface of the shield case 55 or by way of pulleys 64*a*, 64*b* provided to the machine body of the image forming apparatus 1. The pulleys 64*a*, 64*b* and the end of the moving member 54 are not shown in FIG. 2. The end of the moving member 54 is preferably extended as far as the outside of the machine body of the image forming apparatus 1. This enables to clean the needle electrode 50 without detaching the charging apparatus 24 from the image forming apparatus 1 or without opening the image forming apparatus 1.

When cleaning is conducted by a butting the cleaner members 52*a*, 52*b* against the needle electrode 50 by the traction of the moving member 54, the pressing force of the cleaner members 52*a*, 52*b* to the needle electrode 50 is controlled preferably to 10 to 30 gf. In the case where the pressing force is less than 10 gf, contaminants such as a toner or paper dust deposited to the needle electrode 50 can not possibly be removed sufficiently and, on the other hand, the top end of the protrusion 58 of the needle electrode may possibly be fractured by deformation in the case where it exceeds 30 gf.

The pressing force of the cleaner members 52*a*, 52*b* to the needle electrode 50 can be controlled, for example, as described below The force loaded on the cleaner member 52*a* or 52*b* is determined in a state of suspending a weight to one end of the moving member 54. Measurement is conducted for example by connecting a spring balance to the cleaner member 52*a* or 52*b* Then, by selecting a weight to provide a force of 10 to 30 gf loaded on the cleaner member 52*a* or 52*b* and suspending the pre-selected weight to the end of the moving member 54 upon cleaning the needle electrode 50, cleaning can be conducted under a predetermined pressing force. Further, an electric motor adjusted with a rotational torque may be connected to the end of the moving member 54 so that a predetermined pressing force can be loaded.

The grid electrode 56 is disposed between the needle electrode 50 and the photoreceptor drum 23 and, by applying the voltage from the power supply for grid voltage 72 to the grid electrode 56, fluctuation in the charged state on the surface of the photoreceptor drum 23 is controlled to make the charged potential uniform. A nickel PTFE composite plating layer 70 is applied to the surface of the porous plate grid substrate.

The grid electrode 56 can be manufactured in accordance with a known method. An example includes a manufacturing method including chemical polishing step, water washing step, acid dipping step, water washing step, pure water dipping step, nickel plating step, nickel PTFE composition plating step, water washing and drying. Among the steps, the nickel plating step is not an essential step but it is applied optionally.

In the chemical polishing step, a plurality of through holes are formed in a plate metal by applying masking and etching to the plate metal. The etching can be conducted in accordance with a known method, which includes, for example, a method of spraying an etching solution such as an aqueous solution of ferric chloride to the plate metal. For the metal as the material for the plate metal, those that can be fabricated into a grid shape and can be applied with plating can be used and include, for example, stainless steel, aluminum, nickel, copper and iron. Among them, with a view point of improving the durability of the grid electrode 56, stainless steel is particularly preferred. Specific examples of the stainless steel include, for example, SUS304, SUS309 and SUS316. Among them, SUS304 is particularly preferred. Further, copper is particularly preferred in view of the improvement of adhesion with respect to the nickel PTFE composite plating layer 70 and reduction of the manufacturing cost. In a case of using copper, since close adhesion with the nickel PTFE composition plating layer 70 is extremely high, the nickel plating layer may not be formed. While the thickness of the plate metal is not particularly restricted, it is, preferably, from 0.05 to 1 mm and, more preferably, from 0.05 to 0.3 mm.

The plate metal formed with a through hole in the chemical polishing step is applied with water washing, acid cleaning or pure water cleaning in the water washing step, the acid dipping step, the water washing step and the pure water dipping step, by which obstacles are removed from the surface to obtain a needle electrode substrate.

As described above, while the nickel plating step is not an essential step, it is preferably applied in order to enhance the close adhesion of the nickel PTFE composite plating layer 70 to the porous plate grid substrate. While the nickel plating can be conducted by a generally adopted method, electric plating is preferably applied in view of subsequent formation of the nickel PTFE composite plating layer 70. While the thickness of the nickel plating layer is not also particularly restricted, it is, preferably, from 0.03 to 3 μm, more preferably, from 0.5 to 1.5 μm and, particularly preferably, at about 1 μm.

The nickel PTFE composite plating step can be conducted to the porous plate grid substrate, for example, in accordance with an electroless nickel plating method, for example, a catalytic nickel plating method (Kanigen method). As the plating bath, a plating bath formed by adding polytetrafluoroethylene further to an aqueous solution containing hypophosphorus acid or a salt thereof and a nickel salt is used. pH of the plating bath is usually controlled within a range from 5 to 5.5. The polytetrafluoroethylene used herein is a granular polytetrafluoroethylene and the grain diameter is not particularly restricted so long as it is smaller than the thickness of the plating layer to be formed and it is, preferably, 1 μm or less and, more preferably, from 100 to 500 nm. While the addition amount of the polytetrafluoroethylene to the plating bath is not particularly restricted as well, it is, preferably, from 0.01 to 10% by weight and, more preferably, from 0.1 to 1.0% by weight based on the entire weight of the plating bath. Specific examples of the plating solution includes, for example, "KANIFLON S" trade name of products manufactured by Japan Kanigen Co., Ltd., "NIMUFLON" trade name of products manufactured by C. Uemura & Co. Ltd. and "TOP NICOSIT" series trade name of products manufactured by Okuno Chemical Industries Co., Ltd. By dipping the porous plate grid substrate in a plating bath hating the composition and pH as described above and conducting electroless plating at a bath temperature of 90° C. or higher, a nickel PTFE composite plating layer 70 is formed on the surface of the substrate. The content of PTFE in the nickel PTFE composite plating layer 70 thus formed is, preferably, from 3 to 30% by volume and, more preferably, from 20 to 30% by volume. While there is no particular restriction for the thickness of the nickel PTFE composite plating layer 70 thus formed, it is, preferably, 0.3 μm or more, more preferably, from 0.3 to 20 μm and, particularly preferably, from 1 to 5 μm. In the case where the thickness is less than 0.3 μm, pinholes are liable to be formed making the structure not uniform and the charged potential obtained for the photoreceptor tends to be instable partially since the stainless steel of the grid substrate is corroded through pinholes. On the other hand, if the thickness is much larger the 20 μm, plated membranes may possibly be peeled by stress. Since the thickness of the nickel PTFE composite plating layer 70 is substantially in proportion with the plating time, a plating layer of a desired thickness may be obtained by property changing the dipping time of the porous plate grid substrate in the plating bath.

Since the liquid agent of the plating bath is deposited uniformly to the surface of the porous plate grid substrate, the nickel PTFE composite plating layer 70 formed by electroless plating has favorable characteristic that the layer is uniform with no scattering in the thickness and with extremely small pin holes even in the case where the plating layer is as thin as about 0.3 μm. Further, the plating structure is dense and has close adhesion with the surface of the porous plate grid substrate and causes no peeling or the like even when used for a long time.

The nickel PTFE composite plating step can be conducted by electric plating. As the plating bath, an identical plating bath with that for the electroless plating can be used. Conditions for the electric plating are identical with those of usual electric nickel plating. The nickel PTFE composite plating by electric plating has a trend inherent to electric plating, that is, plating tends to be applied to the edge portions, on the other hand, plating tends not to be applied to the portions in which the thorough holes are formed. Therefore, it is necessary to increase the layer thickness in order to make the thickness of the plating layer uniform and it is necessary to preferably make the thickness to 3 μm or more.

In a case of forming the nickel PTFE composite plating layer 70, electroless plating or electric plating is selected in accordance with the feature and the cost of the respective plating methods.

According to the charging apparatus 24, since corona discharge occurs to charge the surface of the photoreceptor drum 23 by the application of the voltage to the needle electrode 50, and the charged state on the surface of the photoreceptor drum 23 is made uniform by the application of a predetermined grid voltage to the plate grid 56, the surface of the photoreceptor drum 23 can be charged up to a predetermined potential and polarity. Further, by the traction of the moving member 54, the support member 53 and, correspondingly, the cleaner members 52*a*, 52*b* abutting against the needle electrode 50 move to remove contaminants such as a toner deposited on the needle electrode 50 efficiently and reliably.

In the charging apparatus 24 in this embodiment, while the needle electrode 50 is used as the corona discharging electrode, this is not limitative but a charging wire may also be used. Any of charging wires used customarily in the relevant field can be used and includes, for example, those applying gold plating to a tungsten wire of 0.06 mm wire diameter.

Referring again to FIG. 1, the light scanning unit 25 includes a laser light source 25*a* comprising a semiconductor laser or the like for emitting a laser light which is modulated in accordance with the image original document information inputted from a document reading station 5 or an external equipment, a polygonal mirror 25*b* for deflecting a laser light emitted from the laser light source 25*a* in the main scanning direction, a lens 25*c* for converging the laser light deflected by the polygonal mirror 25*b* in the main scanning direction so as to be focused to the surface of the photoreceptor drum 23, and mirrors 25*b*, 25*e* for reflecting the laser light converged by the lens 25*c*. The laser light emitted from the laser light source 25*a* is defected by the polygonal mirror 25*b*, further converged by the lens 25*c*, reflected by the mirrors 25*d*, 25*e* and with which is the surface of the photoreceptor drum 23 charged to a predetermined potential and a polarity, to form an electrostatic latent image in accordance with the image original document information.

The developing unit 26 includes developing roller 26*a* disposed opposing to and in press contact with the photoreceptor drum 23 for supplying a developer containing a toner to electrostatic latent images formed on the surface of the photoreceptor drum 23, a supply roller 26*b* disposed so as to be in press contact with the developing roller 26*a* and supplying the developer containing the toner to the developing roller 26*a*, and a casing 26*c* rotationally supporting the developing roller 26*a* and the supply roller 26*b* and containing the developer in the inner space thereof. The developer contained in the casing 26*c* is deposited to the surface of the developing roller 26*a* by rotational driving of the supply roller 26*b*, and supplied from the surface of the developing roller 26*a* to the electrostatic latent images on the surface of the photoreceptor drum 23 thereby developing the electrostatic latent images to obtain toner images.

The developer storing unit 27 is a developer storing container disposed adjacent to the developing unit 26 and supplies an appropriate amount of the developer to the developing unit 26 in accordance with the residual amount of the developer in the developing unit 26.

The transfer unit 28 includes a driving roller 28*a* disposed such that it can be driven rotationally around the axis by driving means (not shown), driven rollers 28*b*, 28*c*, and an endless belt 28*d* extending around the driving roller 28*a* and the driven roller 28*b*, 28*c*. The driving roller 28*a* is not only disposed such that it can drive rotationally but also disposed such that it opposes the photoreceptor drum 23 by way of the endless belt 28*d*, and the photoreceptor drum 23, the endless belt 28*d*, and the driving roller 28*a* are in press contact in this order. According to the transfer unit 28, the recording medium is supplied from the paper feed unit 2 passing through the third conveying channel 33 to a position between the photoreceptor drum 23 and the endless belt 28*d*, and the recording medium is in press contact with the surface of the photoreceptor drum 23 being pressed by the driving roller 28*a* and the toner images on the surface are transferred to the recording medium. After transfer of the toner images as described above, the recording medium is fed to the fixing station 22.

After transferring the toner images by the transfer unit 28 to the recording medium, the cleaning unit 29 removes the toner remaining on the surface of the photoreceptor drum 23 to clean the surface of the photoreceptor drum 23. For the cleaning unit 29, a cleaning blade is used for instance. In the image forming apparatus, an organic photoreceptor drum is used predominantly for the photoreceptor drum 23 and since the surface of the organic photoreceptor mainly comprises a resin ingredient, the surface tends to be degraded by the chemical action of ozone generated by the corona discharge by the charging apparatus. However, the degraded surface portion is worn undergoing the frictional rubbing effect by the cleaning unit 29 and is removed reliably although gradually. Accordingly, the problem of the degradation of the surface by the ozone or the like can be actually overcome and the charged potential by the charging operation can be maintained stably for a long time.

According to the electrophotographic processing station 21, toner images are transferred to the recording medium by conducting a series of operations of forming electrostatic latent images by charging and exposure, forming toner images by the development of the electrostatic latent images, transferring the toner images to the recording medium and cleaning the surface of the photoreceptor drum 23 accompanied to the rotational driving of the photoreceptor drum 23, and the recording medium is fed to the fixing station 22.

The fixing station 22 is disposed such that it can be driven rotationally around the axis and includes a fixing roller 30 having heating means (not shown) at the inside thereof, a pressing roller 31 in press contact with the surface of the fixing roller 30 and disposed such that it can be rotationally driven around the axis, and a temperature sensor 32 disposed so as to oppose the surface of the fixing roller 30 for detecting the surface temperature of the fixing roller 30. As the heating means (not shown) disposed inside the fixing roller 30, heater or the like can be used. Further, the amount of electric power supplied to the heater is controlled by a controller (not shown) such that the surface temperature of the fixing roller 30 is kept at a predetermined temperature in accordance with the result of detection by the temperature sensor 32. According to the fixing station 22, the recording medium transferred with the toner images obtained in the electrophotographic processing station 21 is supplied to a press contact portion between the fixing roller 30 and the pressing roller 31 and undergoes pressing and heating during passage in the press contact portion accompanied to the rotational driving of the fixing roller 30 and the pressing roller 31, by which the toner images are fixed to the recording medium, to obtain an image-recorded recording medium.

According to the image forming station 3, toner images in accordance with the image original document information are transferred to the recording medium fed from the paper feed unit 2 and, further, the toner images are fixed to the recording medium by heating and pressing to obtain a recording medium formed with images of high quality for a long time and continuously.

The paper discharge station 4 includes a fourth conveying channel 34 for feeding the image-recorded recording medium obtained in the fixing station 22 in the image forming station 3 to reversing rollers 36*a*, 36*b* to be described later, the reversing rollers 36*a*, 36*b* for changing the direction of conveying the image-recorded recording medium, a fifth conveying channel 35 for conveying the image-recorded recording medium to a discharge tray (not shown) located outside of the image forming apparatus 1 or to the sixth conveying channel 37, and the sixth conveying channel 37 for conveying the image-recorded recording medium again to the third conveying channel 33. The reversing rollers 36*a*, 36*b* are disposed such that they can be rotate forward and backward around the axis and in press contact with each other. The image-recorded recording medium fed by way of the fourth conveying channel 34 to the press contact portion between the reversing rollers 36*a* and 36*b* is put at the end thereof between the reversing rollers 36*a* and 36*b* by the forward rotation of the reversing rollers 36*a*, 36*b*. Then, the medium is conveyed in the fifth conveying channel 35 by the backward rotation of the reversing rollers 36*a*, 36*b*. Then, in the case where the images are recorded only on one side of the recording medium, it is discharged by the operation of a switching gate (not shown) to a discharge tray (not shown) at the outside of the image forming apparatus 1 in the direction of an arrow 101. Further, in the case where the images are formed on both sides of the recording medium, the medium is conveyed by the operation of a switching gate (not shown) from the fifth conveying channel 35 to the sixth conveying channel 37 and, after being turned upside down, conveyed by way of the third conveying channel to the image forming station 3, where the toner images are transferred and fixed.

The document reading station 5 includes a document feeding station 38 and an image reading station 39. The document feeding station 38 includes a document tray 40 for placing the document, a document control plate 41 for feeding the document, a curved conveying channel 42 for conveying the document with the image surface being reversed, and a protection mat 43 disposed to a surface of contact between the document feeding station 38 and a document platen (platen glass) 44 to be described later. In the document tray 40, a document is placed so as to face up the image surface. The document control plate 41 feeds documents one by one to the curved conveying channel 42. The curved conveying channel 42 conveys the document to a position just above the document platen 44 while reversing the document so as to face down the image surface. Further, the document control plate 41 mainly protects the document tray 44 formed of platen glass. According to the document feeding station 38, after inputting printing conditions such as the number of sheets to be the printed, magnification ratio and the size of paper by condition input keys in an operation panel (not shown) disposed at the frontal portion of the exterior housing of the image forming apparatus 1, the copying operation is started by pushing a start key. Documents to be placed on the document tray 40 with the image surface being faced up are automatically conveyed one by one, put to reversing treatment in the course of conveyance so as to face down the image surface and then conveyed as far as a position just above the document platen 45. Then, while the document passes above the document platen 45, the image document information of the original document is read by the image reading station 39 to be described later. The document passing above the document platen 45 is then discharged by the discharge roller 49 to a discharge tray (not shown) disposed to the outside of the image forming apparatus 1.

The image reading station 39 includes the document platen 44 for placing a document that can not be conveyed automatically and for reading the image document information, a document platen 45 spaced apart from the document platen 44 in the sub-scanning direction, allowing a document that can be conveyed automatically from the document tray 40 to pass and reading image document information upon passage, the light source unit 46 disposed movably in the direction parallel with the surface of the document platens 44, 45 (sub-scanning direction), a mirror unit 47 for guiding a reflection light from the document to a CCD reading unit 48 to be described later and a CCD reading unit 48 for converting a reflection light from the document into electric signals.

The light source unit 46 includes a light source 46*a*, a concaved reflector (not shown) for collecting illumination light for reading emitted from the light source 46*a* to a predetermined reading position of the document platen 44 or the document platen 45, a slit (not shown) for selectively passing only the reflection light from the document, and a mirror 46*b* for reflecting the reflection light from the document further by 90°. The light source unit 46 emits a reading illumination light to the document and supplies a light reflected from the document to the mirror unit 47.

The mirror unit 47 includes a pair of mirrors 47*a*, 47*b* disposed such that the reflection surfaces are cross to each other. The reflection light from the document supplied from the light source unit 46 is deflected for the optical path by 180° by the mirrors 47*a*, 47*b* and is guided to the CCD reading unit 48.

The CCD reading unit 48 includes a focusing lens 48*a* for focusing the reflection light from the mirror unit 47 and a CCD image sensor 48*b* for outputting electric signals in accordance with the light focused by the focusing lens 48*a*. The reflection light entered from the mirror unit 47 to the focusing lens 48*a* is focused, the images are converted by the CCD image sensor 48*b* into electric signals and the image document information as the electric signals is inputted by way of a controller (not shown) to the light scanning unit 25 and image formation corresponding thereto is conducted.

According to the image reading station 39, the image document information of a document placed on the document platen 44, 45 is intaken as a reflection light from the document by the light irradiation from the light source unit 46 and the reflection light is further guided by way of the mirror unit 47 to the CCD reading unit 48 and converted into image document information as electric signals. The information is subjected to image processing under previously determined conditions, and sent to the light scanning unit 25 of the image forming station 3 where image formation is conducted.

Figure 5:
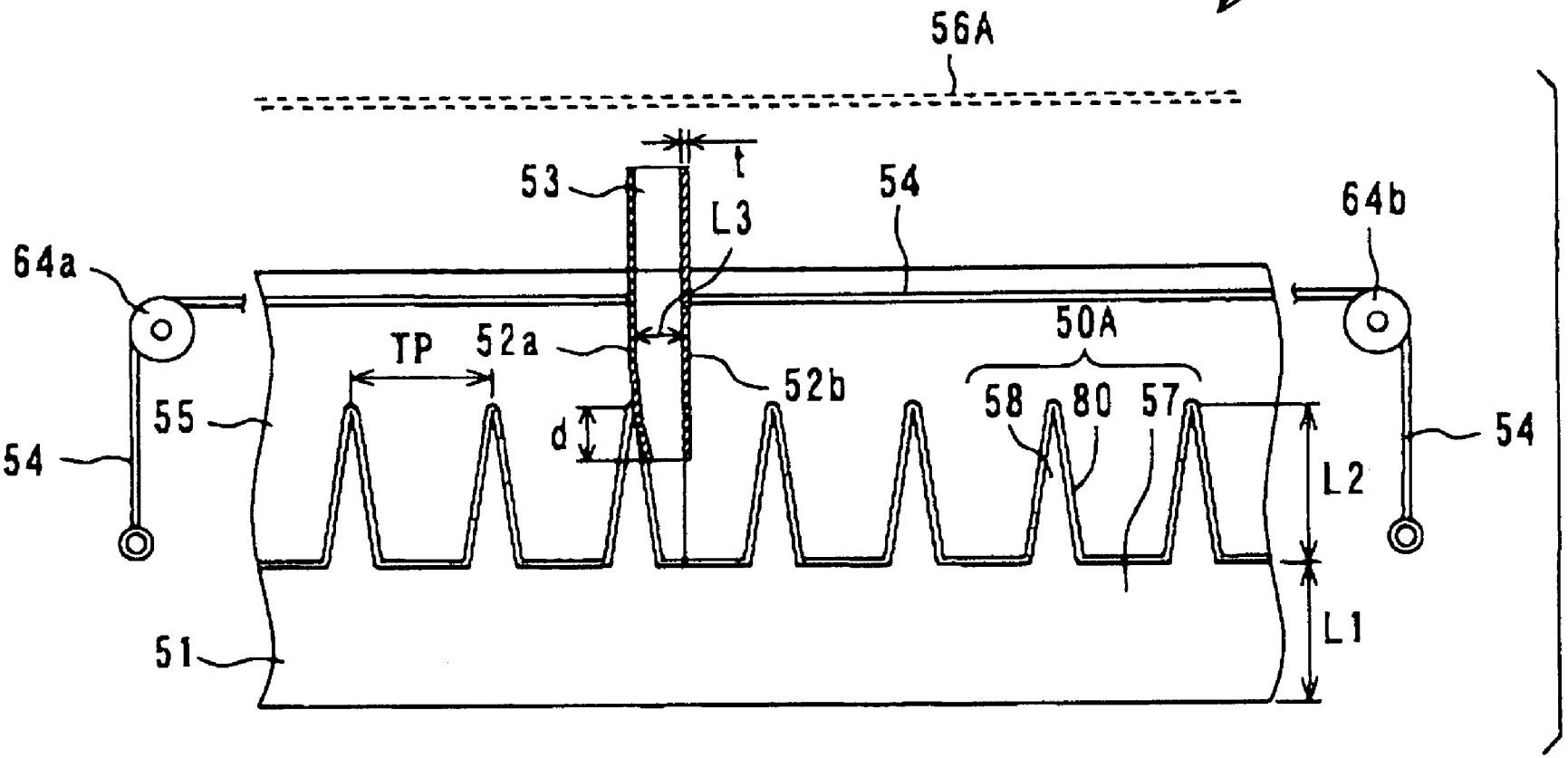
FIG. 5 is a front view of a charging device according to still another example embodiment.
Figure 6:
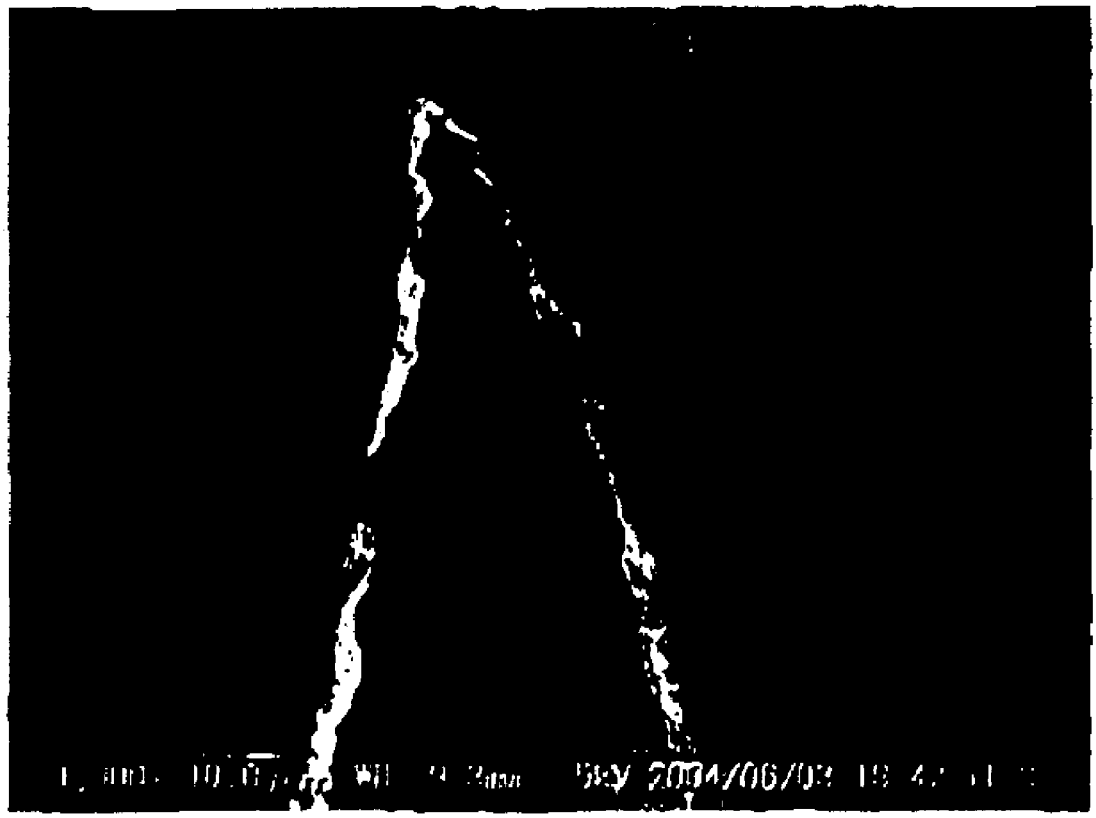
FIG. 6 is a microscopic photograph showing the state at the top end of a needle electrode during corona discharge.

FIG. 5 is a front view of a charging apparatus 24A according to still another example embodiment. The charging apparatus 24A includes a plate electrode 50A, which is similar to the configuration of the charging apparatus 24 shown in FIG. 3, has a plurality of pointed protrusions 58 (hereinafter referred to as "needle electrode 50"), a holding member 51 for holding the needle electrode 50A, two cleaner members 52*a*, 52*b* disposed relatively moveably to the needle electrode 50A for cleaning the surface of the needle electrode 50A by frictionally rubbing the needle electrode 50A upon movement, a support member 53 for supporting the cleaner members 52*a*, 52*b*, a moving member 54 for moving the cleaner members 52*a*, 52*b* and the support member 53, a shield case 55 for containing the needle electrode 50A, the holding member 51, the cleaner members 52*a*, 52*b*, and the support member 53, and a grid electrode 56A for controlling the charged potential on the surface of the photoreceptor drum 23. The charging apparatus 24A is disposed facing the photoreceptor drum 23 along the longitudinal direction of the photoreceptor drum 23 in the electrophotographic processing station 21. The configuration of the charging apparatus 24A is as same as that of the charging apparatus 24 shown in FIG. 4. In this embodiment, the same components as those of the aforementioned embodiment will be denoted by the same reference numerals, and detailed description thereof will be omitted.

The needle electrode 50A is a thin plate member, for example, made of stainless steel in which a nickel PTFE composite plating layer 80 is formed on the surface of a needle electrode substrate constituted by a flat plate 57 extending longitudinally in one direction and pointed protrusions 58 formed so as to protrude from one end face of the flat plate 57 in the shorter direction. Referring, for example, to the size of the needle electrode 50A, the length L1 in the shorter length of the flat plate 57 is preferably about 10 mm, the length L2 in the protruding direction of the protrusion 58 is preferably about 2 mm, the radius of curvature R at the top end of the protrusion 58 is preferably about 40 μm and the pitch TP at which the protrusions 58 are formed is preferably about 2 mm.

The needle electrode 50A can be manufactured in accordance with known methods. One of examples includes a manufacturing method including a chemical polishing step, a water washing step, an acid dipping step, a water washing step, pure water dipping step, a nickel plating step, a nickel PTFE composite plating state, a water washing treatment and a drying treatment. Among the steps, the nickel plating step is not essential but is applied optionally.

In the chemical polishing step, masking and etching are conducted such that a plurality of pointed protrusions are formed to a plate metal. The masking can be conducted in accordance with known methods. Etching can also be conducted in accordance with known methods, which include, for example, a method of spraying an etching solution such as an aqueous solution of ferric chloride to a plate metal. As the material for the plate metal, any metal can be used with no particular restriction so long as corona discharge is possible by the application of voltage, a pointed protrusion can be formed and plating can be applied. For example, the material includes stainless steel, aluminum, nickel, copper, and iron. Among them, stainless steel is preferred. Specific examples of the stainless steel include, for example, SUS304, SUS309, and SUS316 and, among them, SUS304 is preferred. While the thickness of the plate metal is not particularly restricted, it is, preferably, from 0.05 to 1 mm, and, more preferably, from 0.05 to 0.3 mm.

The plate metal formed with a plurality of pointed protrusions in the chemical polishing step is applied with water washing, acid cleaning or pure water cleaning in the water washing step, the acid dipping step, the water washing step and the pure water dipping step, by which obstacles are removed from the surface to obtain a needle electrode substrate.

While the nickel plating can be conducted by a generally practiced method, electric plating is applied preferably considering the subsequent formation of the nickel PTFE composite plating layer 80. Further, while the thickness of the nickel plating layer is not particularly restricted as well, it is, preferably, from 0.03 to 3 μm, more preferably, from 0.5 to 1.5 μm and, particularly preferably, about 1 μm.

The nickel PTFE composite plating step can be conducted, for example, in accordance with an electroless nickel plating method, for example, a catalytic nickel plating method (Kanigen method). As the plating bath, a plating bath formed by adding polytetrafluoroethylene further to an aqueous solution containing hypophosphorus acid or a salt thereof and a nickel salt is used. pH of the plating bath is usually controlled within a range from 5 to 5.5. The polytetrafluoroethylene used herein is a granular polytetrafluoroethylene and the grain diameter is not particularly restricted so long as it is smaller than the thickness of the plating layer to be formed and it is, preferably, 1 μm or less and, more preferably, from 100 to 500 nm. While the addition amount of the polytetrafluoroethylene to the plating bath is not particularly restricted as well, it is, preferably, from 0.01 to 10% by weight and, more preferably, from 0.1 to 1.0% by weight based on the entire weight of the plating bath. Specific examples of the plating solution includes, for example, "KANIFLON S" tradename of products manufactured by Japan Kanigen Co., Ltd., "NIMUFLON" trade name of products manufactured by C. Uemura & Co., Ltd. and "TOP NICOSIT" series trade name of products manufactured by Okuno Chemical Industries Co., Ltd. By dipping the needle electrode substrate in a plating bath having the composition and pH as described above and conducting electroless plating at a bath temperature of 90° C. or higher, a nickel PTFE composite plating layer 80 is formed on the surface of the substrate. The content of PTFE in the nickel PTFE composite plating layer 80 thus formed is, preferably, from 3 to 30% by volume and, more preferably, from 20 to 30% by volume. While there is no particular restriction for the thickness of the nickel PTFE composite plating layer 80 thus formed, it is, preferably, 0.3 μm or more, more preferably, from 0.3 to 20 μm, and, particularly preferably, from 1 to 5 μm. In the case where the thickness is less than 0.3 μm, pinholes are liable to be formed making the structure not uniform and the charged potential obtained for the photoreceptor tends to be instable partially since the stainless steel of the needle electrode substrate is corroded through pinholes. On the other hand, if the thickness is much larger the 20 μm, plated membranes may possibly be peeled by stress. Since the thickness of the nickel PTFE composite plating layer 80 is substantially in proportion with the plating time, a plating layer of a desired thickness may be obtained by property changing the dipping time of the needle electrode substrate in the plating bath.

Since the liquid agent of the plating bath is deposited uniformly to the surface of the needle electrode substrate, the nickel PTFE composite plating layer 80 formed by electroless plating has favorable characteristic that the layer is uniform with no scattering in the thickness and with extremely small pin holes even in the case where the plating layer is as thin as about 0.3 μm. Further, the plating structure is dense and has close adhesion with the surface of the needle electrode substrate and causes no peeling or the like even when used for a long time.

The nickel PTFE composite plating step can be conducted by electric plating. As the plating bath, an identical plating bath with that for the electroless plating can be used. Conditions for the electric plating are identical with those of usual electric nickel plating. Since the nickel PTFE composite plating by electric plating has a trend inherent to electric plating, that is, plating tends to be applied to the edge portions, it is necessary to increase the layer thickness in order to make the thickness of the plating layer uniform and it is necessary to preferably make the thickness to 3 μm or more.

In a case of forming the nickel PTFE composite plating layer 80, electroless plating or electric plating is selected in accordance with the feature and the cost of the respective plating methods.

As well as the aforementioned embodiment, during the operation of in charging the aforementioned photoreceptor drum 23, a voltage at about 5 kV is applied from a power supply 71 for generating corona discharge to the needle electrode 50A. A voltage is applied to the needle electrode 50 from the power supply 71, and corona discharge occurs from the pointed protrusions 58 to the surface of the photoreceptor drum 23 by the application of the voltage to charge the surface of the photoreceptor drum 23.

The grid electrode 56A is located between the needle electrode 50A and the photoreceptor drum 23 and, by the application of voltage from the power supply for grid voltage 72 to the grid electrode 56, controls variation in the charged state on the surface of the photoreceptor drum 23 to unify the charged potential. The grid electrode 56A comprises a metal material as in the needle electrode 50A. Further, the grid electrode 56A can be manufactured in the same manner as that for the needle electrode 50A except for conducting masking and etching such that the grid electrode 56A is formed into a porous state in the chemical polishing step. Further, the same nickel plating, nickel PTFE composite plating, etc. can be applied in the same manner as in the needle electrode 50A.

According to the charging apparatus 24, since corona discharge occurs to charge the surface of the photoreceptor drum 23 by the application of the voltage to the needle electrode 50A, and the charged state on the surface of the photoreceptor drum 23 is made uniform by the application of a predetermined grid voltage to the grid electrode 56A, the surface of the photoreceptor drum 23 can be charged up to a predetermined potential and polarity. Further, by the traction of the moving member 54, the support member 53 and, correspondingly, the cleaner members 52*a*, 52*b* abutting against the needle electrode 50A move to remove contaminants such as a toner deposited on the needle electrode 50A efficiently and reliably.

EXAMPLE

The technology is to be described specifically with reference to examples, reference examples, and comparative examples.

Example 1

A grid substrate comprising stainless steel (SUS304) (sized 30 mm×370 mm×0.1 mm thickness) was applied with etching to prepare a porous plate grid substrate. Etching was conducted by spraying an aqueous 30 wt % solution of ferric chloride to the grid substrate at a liquid temperature of 90° C. for 2 hours. After etching, the grid substrate was water washed and cleaned with pure water to prepare a porous plate grid substrate.

An Ni plating layer of 0.5 μm thickness was formed by electric plating to the surface of the porous plate grid substrate obtained as described above. Then, the grid substrate formed with the Ni plating layer was dipped in a nickel PTFE composite plating bath (trade name of products: NIMUFLON, manufactured by C. Uemura & Co., Ltd., liquid temperature: 90° C.) for 25 min. to manufacture a needle electrode in which a nickel PTFE composite plating layer of 3 μm thickness was formed on the surface. After plating, the needle electrode was taken out of the plating bath and water washing and cleaning with pure water were conducted, followed by drying.

The grid electrode was exchanged for the grid electrode of a charging apparatus in a commercially available image forming apparatus (trade name of products, AR625, manufactured by Sharp Corp.) to manufacture an image forming apparatus including the charging apparatus. Using the grid electrode, the charging apparatus and the image forming apparatus, the following test was conducted. The result is shown in Table 1.

[Discharging Test]

As a test under harsh conditions, an aging test with no paper passage under a low humidity condition (10% or lower) was conducted. Since AR625 is a 70 sheet machine, 71 hours corresponds to the number of copies (300 K life). In the test, the charged potential on the surface of the photoreceptor was set to −630 V at the initial state. Table 1 shows the result of the test.

[Detection for Nitrogen Oxide and Rust]

The rust and nitrogen oxides were detected by microscopic observation for the surface of the grid electrode after discharging.

Reference Example 1

After applying Ni plating in the same manner as in Example 1 to a porous plate grid substrate obtained in the same manner as in Example 1, gold plating was applied to manufacture a grid electrode formed at the surface thereof with a gold plating layer of 0.044 μm. The same performance test as in Example 1 was conducted for the grid electrode. The result is shown in Table 1.

Comparative Example 1

The same grid substrate comprising stainless steel (SUS304) as in Example 1 was used as it was as a grid electrode without applying the plating treatment and put to the same performance test as in Example 1. The result is shown in Table 1.

Comparative Example 2

The grid substrate of the same size as in Example 1 was used as it was as a grid electrode without applying a plating treatment except for changing the stainless steel to SUS316 and put to identical performance test as in Example 1. The result is shown in Table 1.

Comparative Example 3

Electric Ni plating was applied to the same grid substrate comprising stainless steel (SUS304) as in Example 1 to manufacture a grid electrode formed with an Ni plating layer of 3 μm thickness. The grid electrode was put to the same performance test as in Example 1. The result is shown in Table 1.

Comparative Example 4

Electroless Ni plating was applied to the same grid substrate comprising stainless steel (SUS304) as in Example 1 to manufacture a grid electrode formed with an Ni plating layer of 3 μm thickness. The grid electrode was put to the same performance test as in Example 1. The result is shown in Table 1.

Comparative Example 5

A grid electrode was manufactured without applying a plating treatment to the same copper plate (grid substrate) as in Example 1.

TABLE 1

| | Grid electrode | | | Discharge time | Potential increase | | Nitrogen oxide |
|---|---|---|---|---|---|---|---|
| | material | Plating treatment | Under-layer | ks | V | Judgment | and rust |
| Example 1 | SUS304 | Electroless Ni plating + PTFE | Ni | 295 | 8 | ○ | Not detected |
| Reference Example 1 | SUS304 | Gold plating | Ni | 300 | 7 | ○ | Not detected |
| Comparative Example 1 | SUS304 | Not plated | None | 118.1 | 93 | x | Detected |
| Comparative Example 2 | SUS316 | Not plated | None | 127.7 | 100 | x | Detected |
| Comparative Example 3 | SUS304 | Electric Ni plating | None | 81.4 | 50 | x | Detected |
| Comparative Example 4 | SUS304 | Electroless Ni plating | None | 67.2 | 58 | x | Detected |

In view of Table 1, it can be seen that each of the plate grids of Comparative Examples 1, 2 (SUS with no plating) and Comparative Examples 3, 4 (only with nickel plating) showed remarkable increase of the potential and nitrogen oxides and rusts were detected from the surface of the plate grid, whereas the plate grid of Example 1 formed with the nickel PTFE composite plating layer showed potential increase as low as that of the plate grid of Reference Example 1 formed with the gold plating layer on the surface and, further, the nitrogen oxides and the rust ingredients were not detected.

In the image forming apparatus using the plate grid of Example 1, half-tone image were uniform and no unevenness occurred even after printing 50000 sheets in the actual reproduction test, whereas violent unevenness occurred in the half-tone images after printing 10000 sheets in Comparative Examples 1 to 4.

Example 2

A grid electrode was manufactured in the same manner as in Example 1 except for using a copper plate (sized 30 mm×370 mm×0.1 mm thickness) instead of the stainless steel (SUS304) as the grid substrate.

Reference Example 2

A grid electrode was manufactured by applying Ni plating and bold plating in the same manner as in Reference Example 1 to a porous plate grid substrate obtained in the same manner as in Example 2.

Comparative Example 6

A grid electrode formed with an Ni plating layer of 3 μm thickness was manufactured by applying electric Ni plating to the same copper plate (grid substrate) as in Example 1.

Comparative Example 7

A grid electrode formed with an Ni plating layer of 3 μm thickness was manufactured by applying electroless Ni plating to the same copper plate (grid substrate) as in Example 1.

The grid electrodes obtained in Example 2, Reference Example 2, and Comparative Examples 5 to 7 were attached to a commercial image forming apparatus (trade name of products: AR625, manufactured by Sharp Corp.) in the same manner as in Example 1, and a discharging test, as well as detection for nitrogen oxides and rusts were conducted. The results are shown in Table 2.

Further, in the charging apparatus to which the grid electrode of Example 2 was attached, microscopic photograph was taken for examining the state at the top end of the needle electrode when corona discharge was conducted under application of a voltage at 5 kV to the needle electrode. FIG. 4 is a microscopic photograph showing the state at the top end of the needle electrode during corona discharge. From FIG. 4, it is apparent that substantially uniform discharge occurs from the entire portion at the top end of the needle electrode by using the grid electrode of Example 2.

TABLE 2

| | Grid electrode | | | Discharge time | Potential increase | | Nitrogen oxide |
|---|---|---|---|---|---|---|---|
| | material | Plating treatment | Under-layer | ks | V | Judgment | and rust |
| Example 2 | Copper | Electroless Ni plating + PTFE | none | 302 | 8 | ○ | Not detected |

TABLE 2-continued

| | Grid electrode material | Plating treatment | Under-layer | Discharge time ks | Potential increase V | Potential increase Judgment | Nitrogen oxide and rust |
|---|---|---|---|---|---|---|---|
| Reference Example 2 | Copper | Gold plating | Ni | 288 | 8 | ○ | Not detected |
| Comparative Example 5 | Copper | Not plated | none | 58 | 53 | x | Detected |
| Comparative Example 6 | Copper | Electric Ni plating | none | 86 | 56 | x | Detected |
| Comparative Example 7 | Copper | Electroless Ni plating | none | 72 | 51 | x | Detected |

Example 3

A plate metal comprising stainless steel (SUS304) (sized 20 mm×310 mm×0.1 mm thickness) was applied with a masking treatment and an etching treatment to manufacture a needle electrode substrate. Etching was conducted by spraying an aqueous 30 wt % solution of ferric chloride at a liquid temperature of 90° C. to the plate metal of stainless steel for 2 hours. After the etching, the needle electrode substrate was taken out of the etching solution, and water washing and cleaning with pure water were conducted to manufacture a needle electrode substrate.

An Ni plating layer of 0.5 μm thickness was formed by electric plating to the surface of the needle electrode substrate obtained as described above. Then, the needle electrode substrate formed with the Ni plating layer was dipped in a nickel PTFE composite plating bath (trade name of products: NIMUFLON, manufactured by C. Uemura & Co., Ltd., liquid temperature: 90° C.) for 25 min. to manufacture a needle electrode in which a nickel PTFE composite plating layer of 3 μm thickness was formed on the surface. After plating, the needle electrode was taken out of the plating bath and water washing and cleaning with pure water were conducted, followed by drying.

The needle electrode was exchanged for the needle electrode of a charging apparatus in a commercially available image forming apparatus (trade name of products, AR625, manufactured by Sharp Corp.) to manufacture an image forming apparatus including the charging apparatus according to the invention. Using the needle electrode, the charging apparatus and the image forming apparatus, the following test was conducted. The result is shown in Table 1.

[Discharging Test]

As a test under harsh conditions, an aging test with no paper passage under a low humidity condition (10% or lower) was conducted. Since AR625 is a 70 sheet machine, 71 hours corresponds to the number of copies (300 K life). In the test, the charged potential on the surface of the photoreceptor was set to −630 V at the initial state. Table 1 shows the result of the test.

[Detection for Nitrogen Oxide and Rust]

The rust and nitrogen oxides were detected by microscopic observation for the surface of the needle electrode after discharging.

Also after printing 300000 sheets in an actual copying test, while white streaks or black streaks were observed in half-tone images in a case of not applying cleaning for the needle electrode left in the state of the stainless material as it was, the quality of half-tone images was uniform and no unevenness occurred in the needle electrode applied with the plating.

Further, it was found that, due to the smoothness on the surface as the feature of the nickel PTFE composite plating, deposits such as dusts in air were decreased compared with the needle electrode left in the state of the stainless material as it was, and the dusts could be removed simply by cleaning. On the contrary, since contaminants could not be removed sufficiently by cleaning in a case only applying the Ni plating layer, the quality of half-tone images was not recovered uniformly after cleaning.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A charging apparatus comprising:

an electrode for applying a voltage to a surface of a photoreceptor and charging the surface; and a grid electrode disposed between the electrode and the photoreceptor for controlling the charged potential on the surface of the photoreceptor, wherein the grid electrode has a nickel plating layer containing polytetrafluoroethylene on at least one surface of a porous plate grid substrate.

2. The charging apparatus of claim 1, wherein the nickel plating layer containing polytetrafluoroethylene is formed by an electroless plating method.

3. The charging apparatus of claim 1, wherein a thickness of the nickel plating layer containing polytetrafluoroethylene is 0.3 μm or more.

4. The charging apparatus of claim 1, wherein a nickel plating layer is further formed between the porous plate grid substrate and the nickel plating layer containing polytetrafluoroethylene.

5. The charging apparatus of claim 1, wherein the nickel plating layer containing polytetrafluoroethylene contains phosphorus together with nickel as a plating ingredient.

6. The charging apparatus of claim 1, wherein the porous plate grid substrate is a porous stainless steel sheet or porous copper sheet.

7. An image forming apparatus comprising:

a photoreceptor having a surface on which an electrostatic latent image is formed;

the charging apparatus of claim 1 for charging the surface of the photoreceptor;

exposure means for irradiating the surface of the photoreceptor in the charged state with a signal light based on the image information to form an electrostatic latent image;

developing means for developing the electrostatic latent image formed on the surface of the photoreceptor to form a toner image;

transfer means for transferring the toner image to a recording material; and fixing means for fixing the toner image transferred to the recording material.

8. The image forming apparatus of claim 7, further comprising:

surface potential detection means for detecting a surface potential on the photoreceptor; and charge control means for controlling an amount of current supplied to the charging apparatus and/or the grid voltage applied to the grid electrode in accordance with a result of detection obtained by the surface potential detection means.

9. A charging apparatus comprising:

an electrode having a plurality of pointed protrusions for applying a voltage to a surface of a photoreceptor and charging the surface; and a grid electrode disposed between the electrode and the photoreceptor for controlling the charged potential on the surface of the photoreceptor, wherein a nickel plating layer containing polytetrafluoroethylene is formed on at least one surface of the electrode.

10. The charging apparatus of claim 9, wherein the nickel plating layer containing polytetrafluoroethylene is formed by an electroless plating method.

11. The charging apparatus of claim 9, wherein a thickness of the nickel plating layer containing polytetrafluoroethylene is 0.3 μm or more.

12. The charging apparatus of claim 9, wherein a nickel plating layer is further formed between the electrode and the nickel plating layer containing polytetrafluoroethylene.

13. The charging apparatus of claim 9, wherein the nickel plating layer containing polytetrafluoroethylene contains phosphorus together with nickel as a plating ingredient.

14. An image forming apparatus comprising:

a photoreceptor having a surface on which an electrostatic latent image is formed;

the charging apparatus of claim 9 for charging the surface of the photoreceptor;

exposure means for irradiating the surface of the photoreceptor in a charged state with a signal light based on the image information to form an electrostatic latent image;

developing means for developing the electrostatic latent image formed on the surface of the photoreceptor to form a toner image;

transfer means for transferring the toner image to a recording material; and fixing means for fixing the toner image transferred to the recording material.

15. The image forming apparatus of claim 14, further comprising:

surface potential detection means for detecting a surface potential on the photoreceptor; and charge control means for controlling an amount of current supplied to the charging apparatus and/or the grid voltage applied to the grid electrode in accordance with a result of detection obtained by the surface potential detection means.

* * * * *